US011152145B2

(12) United States Patent
Nakano et al.

(10) Patent No.: US 11,152,145 B2
(45) Date of Patent: Oct. 19, 2021

(54) SOFT MAGNETIC METAL POWDER, DUST CORE, AND MAGNETIC COMPONENT

(71) Applicant: TDK CORPORATION, Tokyo (JP)

(72) Inventors: Takuma Nakano, Tokyo (JP); Kazuhiro Yoshidome, Tokyo (JP); Hiroyuki Matsumoto, Tokyo (JP); Satoko Mori, Tokyo (JP); Seigo Tokoro, Tokyo (JP); Kenji Horino, Tokyo (JP)

(73) Assignee: TDK CORPORATION, Tokyo (JP)

( * ) Notice: Subject to any disclaimer, the term of this patent is extended or adjusted under 35 U.S.C. 154(b) by 355 days.

(21) Appl. No.: 16/296,394

(22) Filed: Mar. 8, 2019

(65) Prior Publication Data

US 2019/0279797 A1 Sep. 12, 2019

(30) Foreign Application Priority Data

Mar. 9, 2018 (JP) ..... JP2018-043648

(51) Int. Cl.

| | |
|---|---|
| ***H01F 3/00*** | (2006.01) |
| ***H01F 1/153*** | (2006.01) |
| ***H01F 1/147*** | (2006.01) |
| ***H01F 3/08*** | (2006.01) |
| ***H01F 1/24*** | (2006.01) |
| ***H01F 1/33*** | (2006.01) |
| ***H01F 1/26*** | (2006.01) |
| *H01F 41/02* | (2006.01) |

(52) U.S. Cl.

CPC ..... *H01F 1/15308* (2013.01); *H01F 1/14766* (2013.01); *H01F 1/24* (2013.01); *H01F 1/26* (2013.01); *H01F 1/33* (2013.01); *H01F 3/08* (2013.01); *H01F 1/15333* (2013.01); *H01F 41/0246* (2013.01)

(58) Field of Classification Search

CPC ..... H01F 1/15308; H01F 3/08; H01F 1/24; H01F 1/33; H01F 1/26; H01F 1/15358; H01F 17/04; H01F 1/14766; H01F 1/15333; H01F 41/0246; H01F 1/15383; H01F 27/255; H01F 1/153; H01F 1/38; H01F 1/22; B22F 1/02; B22F 2301/35; B22F 2304/10

USPC ..... 335/297

See application file for complete search history.

(56) References Cited

U.S. PATENT DOCUMENTS

2012/0082844 A1* 4/2012 Takahashi ..... H01F 1/33 428/336
2015/0130573 A1* 5/2015 Araki ..... B22F 1/0011 335/297
2019/0279797 A1* 9/2019 Nakano ..... H01F 1/26

(Continued)

FOREIGN PATENT DOCUMENTS

JP 2015-132010 A 7/2015

*Primary Examiner* — Shawki S Ismail
*Assistant Examiner* — Lisa N Homza
(74) *Attorney, Agent, or Firm* — Oliff PLC

(57) ABSTRACT

Soft magnetic metal powder which includes a plurality of soft magnetic metal particles configured by a Fe-based nanocrystal alloy including Cu is provided, wherein the soft magnetic metal particles have core portions and first shell portions surrounding circumferences of the core portions; when an average crystallite size of Cu crystallites existing in the core portions is set as A, and the largest crystallite size of Cu crystallites existing in the first shell portions is set as B, B/A is 3.0 or more and 1000 or less.

9 Claims, 5 Drawing Sheets

(56) References Cited

U.S. PATENT DOCUMENTS

| | | | | |
|---|---|---|---|---|
| 2019/0279798 | A1* | 9/2019 | Mori | H01F 1/14733 |
| 2019/0279799 | A1* | 9/2019 | Hosono | H01F 27/255 |
| 2019/0279801 | A1* | 9/2019 | Yoshidome | B22F 1/02 |
| 2019/0279802 | A1* | 9/2019 | Yoshidome | H01F 1/24 |
| 2020/0303105 | A1* | 9/2020 | Okuda | H01F 3/08 |
| 2020/0306831 | A1* | 10/2020 | Mori | H01F 1/14766 |
| 2021/0035719 | A1* | 2/2021 | Mori | H01F 1/153 |
| 2021/0035720 | A1* | 2/2021 | Mori | B22F 1/02 |
| 2021/0098164 | A1* | 4/2021 | Koeda | H01F 1/24 |

* cited by examiner

SOFT MAGNETIC METAL POWDER, DUST CORE, AND MAGNETIC COMPONENT

BACKGROUND OF THE INVENTION

Field of the Invention

The present invention relates to soft magnetic metal powder, a dust core and a magnetic component.

Description of the Related Art

As magnetic components used in power circuits of various electronic equipment, a transformer, a choke coil, an inductor and the like are known.

The magnetic component has a configuration in which a coil (a winding), which is an electrical conductor, is disposed around or inside a core exerting predetermined magnetic properties.

Miniaturization and high-performance are required for the core included in the magnetic component such as the inductor or the like. As a soft magnetic material with good magnetic properties used in the core, an iron (Fe)-based nanocrystal alloy is exemplified. The nanocrystal alloy is an alloy in which microcrystals of a nanometer order are deposited in an amorphous substance by heat-treating an amorphous alloy or an alloy having a nano-heterostructure in which initial microcrystals exist in the amorphous substance.

The core can be obtained as a dust core by compressing and molding soft magnetic metal powder including particles configured by the nanocrystal alloy. In the dust core, in order to improve the magnetic properties, a proportion (a filling ratio) of the magnetic composition is increased. However, because the nanocrystal alloy has low insulation, a problem arises in that when the particles configured by the nanocrystal alloy contact with each other, loss caused by an electric current flowing between contacting particles (an eddy current between the particles) is large when a voltage is applied to the magnetic component, as a result, core loss of the dust core becomes large.

Therefore, in order to suppress the eddy current, insulating films are formed on surfaces of the soft magnetic metal particles. For example, in Japanese Patent Laid-Open No. 2015-132010, it is disclosed that powder glass including oxide of phosphorus (P) is softened by mechanical friction and adhered on the surface of Fe-based amorphous alloy powder, thereby forming an insulating coating layer.

In Japanese Patent Laid-Open No. 2015-132010, the Fe-based amorphous alloy powder, on which the insulating coating layer is formed, is mixed with resins and formed into a dust core by compressing and molding. In the dust core, as described above, in order to obtain good magnetic properties, it is necessary to improve the filling ratio of the magnetic composition. Accordingly, the thickness of the insulating coating layer cannot be thickened without limitation. Therefore, in order to obtain good magnetic properties even with comparatively thin insulating coating layers, it is necessary to improve withstand voltage of the soft magnetic metal particles themselves.

SUMMARY OF THE INVENTION

The present invention is made in light of such circumstances, and an object thereof is to provide a dust core having good withstand voltage, a magnetic component including the dust core and soft magnetic metal powder suitable for the dust core.

The present inventors obtained a view that, sizes and an existing state of nanocrystals dispersing in the amorphous substance have influence on the insulation of particles. The present inventors found, based on this view, that the withstand voltage of a dust core including the particles is improved by differentiating the size and the existing state of the nanocrystals in the particles between surface sides of the particles having great influence on the insulation and center sides of the particles having almost no influence on the insulation, and the present invention is thus achieved.

That is, an aspect of the present invention is

[1] soft magnetic metal powder, including a plurality of soft magnetic metal particles configured by Fe-based nanocrystal alloy including Cu, wherein the soft magnetic metal particles have core portions and first shell portions surrounding circumferences of the core portions;

B/A is 3.0 or more and 1000 or less, in which an average crystallite size of Cu crystallites existing in the core portions is set as A, and the largest crystallite size of the Cu crystallites existing in the first shell portions is set as B.

[2] The soft magnetic metal powder according to [1], wherein C/A is 2.0 or more and 50 or less, in which the average crystallite size of the Cu crystallites existing in the core portions is set as A, and an average crystallite size of the Cu crystallites existing in the first shell portions is set as C.

[3] The soft magnetic metal powder according to [1] or [2], wherein D is 3.0 nm or more and 20 nm or less, in which an average minor axis diameter of the Cu crystallites existing in the first shell portions is set as D.

[4] The soft magnetic metal powder according to any one of [1] to [3], wherein an average crystallite size of Fe crystallites of the soft magnetic metal particles is 1.0 nm or more and 30 nm or less.

[5] The soft magnetic metal powder according to any one of [1] to [4], wherein the soft magnetic metal particles have second shell portions surrounding circumferences of the first shell portions, and the second shell portions are layers including Cu or Cu oxide.

[6] The soft magnetic metal powder according to any one of [1] to [5], wherein surfaces of the soft magnetic metal particles are coated by coating portions; and the coating portions include a compound of one or more elements selected from a group consisting of P, Si, Bi, and Zn.

[7] A dust core, which is configured by the soft magnetic metal powder according to any one of [1] to [6].

[8] A magnetic component, including the dust core according to [7].

According to the present invention, the dust core with good withstand voltage, the magnetic component including the dust core and the soft magnetic metal powder suitable for the dust core can be provided.

DETAILED DESCRIPTION OF THE PREFERRED EMBODIMENTS

Figure 1:
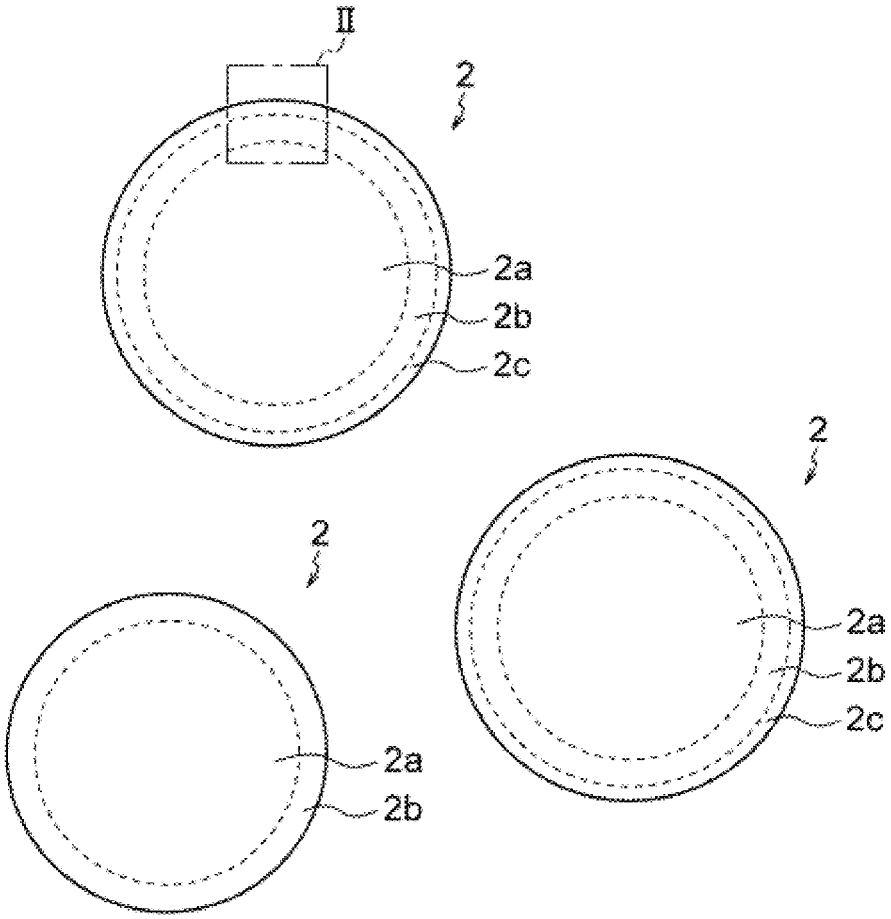
FIG. 1 is a schematic cross-sectional view of soft magnetic metal particles configuring soft magnetic metal powder of the embodiment.

Hereinafter, the present invention is specifically described based on a detailed embodiment shown in the drawings in the following order.

1. Soft Magnetic Metal Powder
   1.1. Soft Magnetic Metal Particle
   1.1.1. Core Portion
   1.1.2. First Shell Portion
   1.1.3. Second Shell Portion
   1.2. Coating Portion
2. Dust Core
3. Magnetic Component
4. Method for Producing Dust Core
   4.1. Method for Producing Soft Magnetic Metal Powder
   4.2. Method for Producing Dust Core (1. Soft Magnetic Metal Powder)

As shown in FIG. 1, the soft magnetic metal powder of the embodiment includes a plurality of soft magnetic metal particles 2. Furthermore, shapes of the soft magnetic metal particles 2 are not particularly limited and are usually spherical.

In addition, an average particle size (D50) of the soft magnetic metal powder of the embodiment may be selected corresponding to the application and the material. In the embodiment, the average particle size (D50) is preferably within a range of 0.3-100 μm. Sufficient moldability or predetermined magnetic properties are easily maintained by setting the average particle size of the soft magnetic metal powder within the above range. A measurement method of the average particle size is not particularly limited, and a laser diffraction scattering method is preferably used.

(1.1. Soft Magnetic Metal Particle)

In the embodiment, the soft magnetic metal particles are configured by a Fe-based nanocrystal alloy including Cu. The Fe-based nanocrystal alloy is an alloy in which microcrystals of a nanometer order are deposited in an amorphous substance by heat-treating a Fe-based amorphous alloy or a Fe-based alloy having a nano-heterostructure in which initial microcrystals exist in the amorphous substance. In the embodiment, crystallites composed of Fe (Fe crystallites) and crystallites composed of Cu (Cu crystallites) disperse in the amorphous substance. Furthermore, Cu is preferably included in the Fe-based nanocrystal alloy by 0.1 atom % or more.

The Fe-based nanocrystal alloy including Cu may be, for example, Fe—Si—Nb—B—Cu-based nanocrystal alloy, Fe—Nb—B—P—Cu-based nanocrystal alloy, Fe—Nb—B—P—Si—Cu-based nanocrystal alloy, Fe—Nb—B—P—Cu—C-based nanocrystal alloy, and Fe—Si—P—B—Cu-based nanocrystal alloy or the like.

In the embodiment, the soft magnetic metal powder may only include soft magnetic metal particles having the same material, or the soft magnetic metal particles having different materials may be mixed in the soft magnetic metal powder. For example, the soft magnetic metal powder may be a mixture of a plurality of Fe—Si—Nb—B—Cu-based nanocrystal alloy particles and a plurality of Fe—Nb—B—P—Cu-based nanocrystal alloy particles.

Furthermore, the difference in materials includes an occasion that the elements configuring the metal or the alloy are different, an occasion that even if the elements configuring the metal or the alloy are the same, the compositions are different, or the like.

In addition, the average crystallite size of the Fe crystallites is preferably 1.0 nm or more and 50 nm or less, and more preferably 5.0 nm or more and 30 nm or less. By setting the average crystallite size of the Fe crystallites within the above range, when coating portions described later are formed on the soft magnetic metal particles, an increase in coercivity can be suppressed even when stress is applied to the particles. The average crystallite size of the Fe crystallites can be calculated, for example, based on a half-value width obtained by predetermined peaks of diffraction patterns obtained by an X-ray diffraction measurement of the soft magnetic metal powder.

Figure 2:
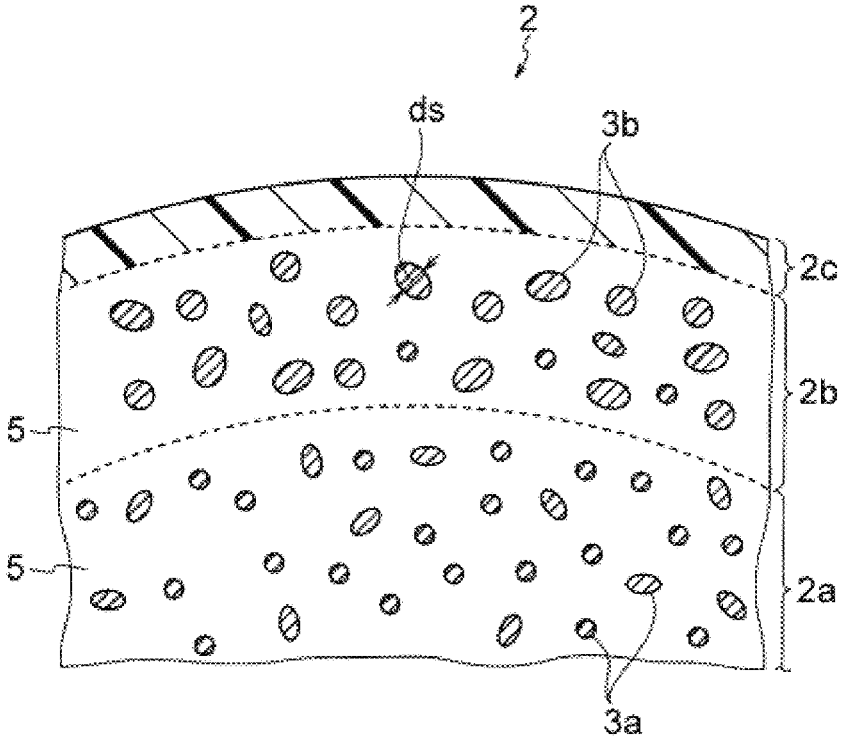
FIG. 2 is an enlarged schematic cross-sectional view diagram in which the II part shown in FIG. 1 is enlarged.

In addition, in the embodiment, as shown in FIG. 1 and FIG. 2, the soft magnetic metal particles at least have core portions 2*a*, and first shell portions 2*b* surrounding circumferences of the core portions 2*a*. Although both of the core portions 2*a* and the first shell portions 2*b* have structures in which the Fe crystallites and the Cu crystallites disperse in the amorphous substance, in the core portions and the first shell portions, at least existence forms of the Cu crystallites are different. In the following, the core portions and the first shell portions are described in detail.

(1.1.1. Core Portion) The core portions 2*a* are regions including centers of the soft magnetic metal particles 2, and as shown in FIG. 2, are regions where the Fe crystallites (not illustrated) and the Cu crystallites 3*a* uniformly disperse in the amorphous substance 5. In the embodiment, when the average crystallite size of the Cu crystallites 3*a* existing in the core portions 2*a* is set as A [nm], A is preferably 0.1 nm or more and 30 nm or less. In addition, A is more preferably 1 nm or more, and further preferably 10 nm or less.

As described later, A has a prescribed relationship with the largest crystallite size B of the Cu crystallites existing in the first shell portions.

(1.1.2. First Shell Portion)

The first shell portions 2*b* are regions surrounding the circumferences of the core portions 2*a*. As shown in FIG. 2, similar to the core portions 2*a*, in the first shell portions 2*b*, Cu crystallites 3*b* also disperse and exist in the amorphous substance 5, but crystallite sizes of the Cu crystallites 3*b* existing in the first shell portions 2*b* tend to be larger than the crystallite sizes of the Cu crystallites 3*a* existing in the core portions 2*a*. In the embodiment, when the largest crystallite size among the crystallite sizes of the Cu crystallites 3*b* existing in the first shell portions 2*b* (the largest crystallite size) is set as B [nm], B/A is 3.0 or more and 1000 or less. That is, the Cu crystallites 3*b*, which are larger than the Cu crystallites 3*a* existing on center sides (the core portions 2*a*) of the soft magnetic metal particles 2, are made to exist on surface sides (the first shell portions 2*b*) of the soft magnetic metal particles 2. In this way, withstand voltage of a dust core including the soft magnetic metal particles is improved.

B/A also depends on a value of the average crystallite size A of the Cu crystallites 3*a* existing in the core portions 2*a*, and is preferably 5.0 or more and 80.0 or less when A is about 5 nm. When B/A is too large, there is a tendency that greatly grown crystals of Cu are deposited on the surfaces of the particles and insulation between the particles is reduced accordingly, leading to a decrease in the withstand voltage property.

Further, when the average crystallite size of the Cu crystallites 3*b* existing in the first shell portions 2*b* is set as C [nm], C is preferably 2.0 nm or more, and more preferably 5.0 nm or more. In addition, C is preferably 100 nm or less, and more preferably 50 nm or less. When C is too large, similar to the occasion of B/A, there is a tendency that greatly grown crystals of Cu are deposited on the surfaces of the particles and insulation between the particles is reduced accordingly, leading to a decrease in the withstand voltage property.

In addition, C/A, which shows a ratio of the average crystallite size (C) of the Cu crystallites 3*b* existing in the first shell portions 2*b* with respect to the average crystallite size (A) of the Cu crystallites 3*a* existing in the core portions 2*a*, is preferably 2.0 or more and 50 or less.

Note that, conventionally, it is considered that properties are improved by uniformly dispersing the crystallites deposited in the amorphous substance over the entire particles. However, in the embodiment, by differentiating the size and the existing state of the Cu crystallites between the center sides and the surface sides of the soft magnetic metal particles, the withstand voltage of the soft magnetic metal particles can be improved.

In addition, in cross section shapes of the Cu crystallites existing in the first shell portions, when minimum diameters passing through centers are set as minor axis diameters ds, an average value of the minor axis diameters ds (an average minor axis diameter: D [nm]) is preferably 1.0 nm or more and 20 nm or less.

In the embodiment, the average crystallite size is a diameter of a circle (an equivalent circle diameter) having an area the same as the area in which a cumulative distribution of the area of the crystallites is 50% (D50). As for the areas of the Cu crystallites, the Cu crystallites existing in the core portions and the first shell portions are respectively identified from observation images obtained by observing the Cu crystallites appearing on the cross sections of the soft magnetic metal particles by TEM or the like, and the areas of the Cu crystallites can be calculated by image processing software or the like. The number of the crystallites for which the areas are measured is about 100-500.

In addition, the largest crystallite size is a diameter of a circle (an equivalent circle diameter) having an area the same as the largest area among the areas of the Cu crystallites calculated in the first shell portions.

In addition, the average minor axis diameter is a minor axis diameter for which a cumulative distribution of the minor axis diameter of the Cu crystallites is 50% (D50). As for the minor axis diameters, similar to the above average crystallite size, the Cu crystallites are identified, and the minimum diameters passing through the centers of the crystallites in the Cu crystallites identified in the first shell portions are calculated as the minor axis diameters.

Thicknesses of the first shell portions 2*b* are not particularly limited as long as the effect of the present invention is obtained. In the embodiment, the thicknesses of the first shell portions 2*b* are preferably about 1/100 of the particle diameters of the soft magnetic metal particles.

The core portions and the first shell portions can be distinguished by observing a distribution of Cu by an element analysis of energy dispersive X-ray spectroscopy (EDS) which uses a transmission electron microscope (TEM) such as a scanning transmission electron microscope (STEM) or the element analysis of electron energy loss spectroscopy (EELS).

For example, first, the crystallite sizes of Cu are calculated by STEM-EDS for the center portions of the soft magnetic metal particles 2 and the surface sides of the soft magnetic metal particles 2. On the center portions and the surface sides, when sizes of the calculated crystallite sizes of Cu are changed, it means that it is divided into the core portions and the shell portions. Furthermore, as a method for identifying the Cu crystallites, a three-dimensional atomic probe (sometimes referred to as 3DAP hereinafter) is used to measure the composition distribution and the sizes of the Cu crystallites can be identified. In addition, the Cu crystallites can be identified from information such as lattice constants or the like obtained from a fast Fourier transform (FFT) analysis or the like of the TEM images.

(1.1.3. Second Shell Portion)

In the embodiment, the soft magnetic metal particles 2 may also have second shell portions 2*c*. As shown in FIG. 1 and FIG. 2, the second shell portions 2*c* are formed in a manner of covering circumferences of the first shell portions 2*b*.

In the embodiment, the second shell portions are regions including Cu or Cu-containing oxide and are crystalline regions. Different from the core portions and the first shell portions described above, Cu or the Cu-containing oxide is not dispersed in the amorphous substance but continuously exists in the second shell portions 2*c* and forms layer-like regions. The insulation is improved by forming the second shell portions 2*c* in the soft magnetic metal particles 2, and thus the withstand voltage can be further improved.

Furthermore, the second shell portions 2*c* are mainly configured by components not contributing to the improvement of the magnetic properties. Therefore, when the soft magnetic metal particles do not have the second shell portions, although the withstand voltage is slightly reduced, a proportion of the components contributing to the improvement of the magnetic properties can be improved, and thus the saturation magnetic flux density can be improved for example.

Thicknesses of the second shell portions 2*c* are not particularly limited as long as the effect of the present invention is obtained. In the embodiment, the thicknesses of the second shell portions 2*c* are preferably 5 nm-100 nm.

(1.2. Coating Portion)

Figure 3:
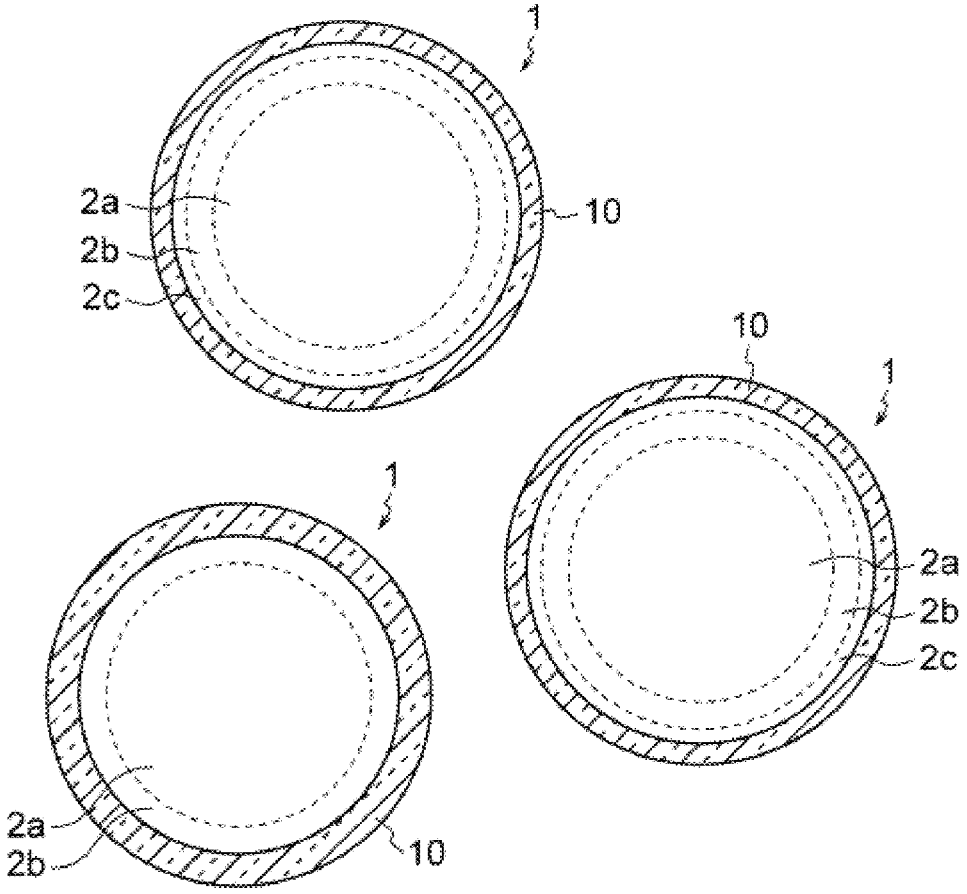
FIG. 3 is a schematic cross-sectional view of coated particles configuring the soft magnetic metal powder of the embodiment.

In the embodiment, the soft magnetic metal particles may be coated particles with the coating portions. As shown in FIG. 3, in the coated particles 1, the coating portions 10 are formed in a manner of covering the surfaces of the soft magnetic metal particles 2. Therefore, when the soft magnetic metal particles 2 have the second shell portions 2*c*, the coating portions 10 are formed in a manner of covering the surfaces of the second shell portions 2*c*, and when the soft magnetic metal particles 2 do not have the second shell portions 2*c*, the coating portions 10 are formed in a manner of covering the surfaces of the first shell portions.

In addition, in the embodiment, coating the surfaces by a substance means a form in which the substance is brought into contact with the surfaces and is fixed so as to cover the contacted parts. In addition, the coating portion coating the soft magnetic metal particle may cover at least part of the surface of the particle, and preferably covers the entire surface. Furthermore, the coating portion may continuously or intermittently cover the surface of the particle.

The coating portions 10 are not particularly limited as long as they are configurations capable of insulating the soft magnetic metal particles configuring the soft magnetic metal powder from one another. In the embodiment, the coating portions 10 preferably include a compound of one or more elements selected from a group consisting of P, Si, Bi and Zn. In addition, the compound is more preferably an oxide, and particularly preferably oxide glass.

Further, the compound of one or more elements selected from the group consisting of P, Si, Bi and Zn is preferably included as a main component in the coating portions 10. That "an oxide of one or more elements selected from the group consisting of P, Si, Bi and Zn is included as the main component" means, when a total amount of the elements except oxygen among the elements included in the coating portions 10 is set as 100 mass %, the total amount of the one or more elements selected from the group consisting of P, Si, Bi and Zn is the largest. In addition, in the embodiment, the total amount of these elements is preferably 50 mass % or more, and more preferably 60 mass % or more.

The oxide glass is not particularly limited and may be, for example, phosphate ($P_2O_5$) glass, bismuthate ($Bi_2O_3$) glass, borosilicate ($B_2O_3$—$SiO_2$) glass or the like.

The $P_2O_5$-based glass is preferably the glass containing 50 wt % or more of $P_2O_5$, and $P_2O_5$—ZnO—$R_2O$—$Al_2O_3$ glass or the like is exemplified. Note that, "R" represents an alkali metal.

The $Bi_2O_3$-based glass is preferably the glass containing 50 wt % or more of $Bi_2O_3$, and $Bi_2O_3$—ZnO—$B_2O_3$—$SiO_2$ glass or the like is exemplified.

The $B_2O_3$—$SiO_2$-based glass is preferably the glass containing 10 wt % or more of $B_2O_3$ and 10 wt % or more of $SiO_2$, and BaO—ZnO—$B_2O_3$—$SiO_2$—$Al_2O_3$ glass or the like is exemplified.

The insulation of the particles is further improved by having the coating portions with such insulation, so that the withstand voltage of the dust core configured by the soft magnetic metal powder including the coated particles is improved.

In the embodiment, when a number proportion of the particles included in the soft magnetic metal powder is set as 100%, the number proportion of the coated particles is preferably 90% or more, and preferably 95% or more.

The components included in the coating portions can be identified from the information such as the lattice constants or the like obtained from the element analysis of EDS using a TEM such as a STEM or the like, the element analysis of EELS, the FFT analysis of the TEM images, and the like.

Thicknesses of the coating portions 10 are not particularly limited as long as the above effect is obtained. In the embodiment, the thicknesses are preferably 5 nm or more and 200 nm or less. In addition, the thicknesses are preferably 150 nm or less, and more preferably 50 nm or less.

(2. Dust Core)

The dust core of the embodiment is not particularly limited as long as the dust core is configured by the above soft magnetic metal powder and is formed to have a predetermined shape. In the embodiment, the soft magnetic metal powder and a resin serving as a binding agent are included, and the dust core is fixed into the predetermined shape by binding the soft magnetic metal particles configuring the soft magnetic metal powder with one another via the resin. In addition, the dust core may also be configured by mixture powder of the above soft magnetic metal powder and other magnetic powder and formed into the predetermined shape.

(3. Magnetic Component)

The magnetic component of the embodiment is not particularly limited as long as the above dust core is included. For example, the magnetic component of the embodiment may be a magnetic component in which an air core coil wound with wires is buried inside the dust core with the predetermined shape, or a magnetic component in which wires are wound for a predetermined number of turns on a surface of the dust core with the predetermined shape. The magnetic component of the embodiment has good withstand voltage, and thus the magnetic component is suitable for a power inductor used in a power circuit.

(4. Method for Producing Dust Core)

Next, a method for producing the dust core included in the above magnetic component is described. First, the method for producing the soft magnetic metal powder configuring the dust core is described.

(4.1. Method for Producing Soft Magnetic Metal Powder)

The soft magnetic metal powder of the embodiment can be obtained using the method the same as the publicly known method for producing soft magnetic metal powder. Specifically, the soft magnetic metal powder can be produced using a gas atomization method, a water atomization method, a rotary disk method or the like. In addition, the soft magnetic metal powder can also be produced by mechanically pulverizing ribbons obtained by a single-roll method. Among these methods, from a point of view of easily obtaining the soft magnetic metal powder having desirable magnetic properties, the gas atomization method is preferably used.

In the gas atomization method, first, a molten metal in which raw materials of the nanocrystal alloy configuring the soft magnetic metal powder are melted is obtained. The raw materials (pure metals and the like) of each metal element included in the nanocrystal alloy are prepared and weighed so as to achieve the composition of the finally obtained nanocrystal alloy, and the raw materials are melted. Note that, a method for melting the raw materials of the metal elements is not particularly limited, and for example, the method of vacuuming within a chamber of an atomization device and subsequently melting the raw materials by high frequency heating is exemplified. A temperature at the time of melting may be determined by considering a melting point of each metal element, and the temperature may be set to 1200-1500° C. for example.

The obtained molten metal is supplied into the chamber in the form of linear continuous fluid through a nozzle provided on the bottom of a crucible, high-pressure gas is blown to the supplied molten metal to make the molten metal into droplets and rapidly cool the molten metal to obtain fine powder. The obtained powder is configured by the amorphous alloy in which each metal element uniformly disperses in the amorphous substance, or the alloy having the nano-heterostructure. A gas blowing temperature, a pressure within the chamber and the like may be determined corresponding to conditions under which the nanocrystals (the Fe crystallites and the Cu crystallites) are easily deposited in the amorphous substance in the heat treatment described later. In addition, as for the particle diameters, a particle diameter adjustment can be made by a sieve classification, an air stream classification or the like.

Then, the obtained powder is treated with heat. Although the heat treatment for making the nanocrystals deposited in the amorphous substance and the heat treatment for forming the core portions and the shell portions (the first shell portions and the second shell portions) in the soft magnetic metal particles may be carried out separately, in the embodiment, the heat treatment for making the nanocrystals deposited doubles as the heat treatment for forming the core portions and the shell portions.

In the heat treatment, oxygen concentration in the atmosphere is preferably 100 ppm or more and 20000 ppm or less, preferably 10000 ppm or less, and more preferably 5000 ppm or less. The heat treatment for making the nanocrystals deposited usually reduces the oxygen concentration greatly, for example, to 10 ppm or less, but in the embodiment, a dispersion state of the Cu crystallites can have a deviation in the soft magnetic metal particles mainly by setting the oxygen concentration within the above range. As a result, the core portions and the shell portions are formed easily. When the oxygen concentration is too large, the Cu crystallites existing in the first shell portions grow too much. Particularly, when the coating portions described later are formed, because the Cu crystallites are aggregated, there is a tendency that the grown Cu crystallites fall from the soft magnetic metal particles, the falling Cu intrudes into an insulation portion and the withstand voltage decreases.

In addition, the heat treatment temperature is preferably 500° C. or higher and 700° C. or lower, a holding time is preferably 10 minutes or longer and 120 minutes or shorter, a temperature raising rate is preferably 50° C./min or lower. These heat treatment conditions can also control the dispersion state of the Cu crystallites.

After the heat treatment, the powder is obtained which includes the soft magnetic metal particles which are configured by the nanocrystal alloy and in which the core portions, the first shell portions and the second shell portions are formed. Note that, although the second shell portions improve the withstand voltage as described above, the second shell portions are regions disadvantageous for the improvement of the magnetic properties, and thus the second shell portions may be removed from the obtained powder corresponding to the desired properties. A method for removing the second shell portions is not particularly limited, for example, an etching processing in which the powder is brought into contact with a fluid for melting the components configuring the second shell portions to remove the second shell portions, or the like is exemplified.

Then, the coating portions are formed on the obtained soft magnetic metal particles. The method for forming the coating portions is not particularly limited, and the publicly known method can be adopted. A wet processing may be carried out to the soft magnetic metal particles to form the coating portions, or a dry processing may also be carried out to form the coating portions.

Figure 4:
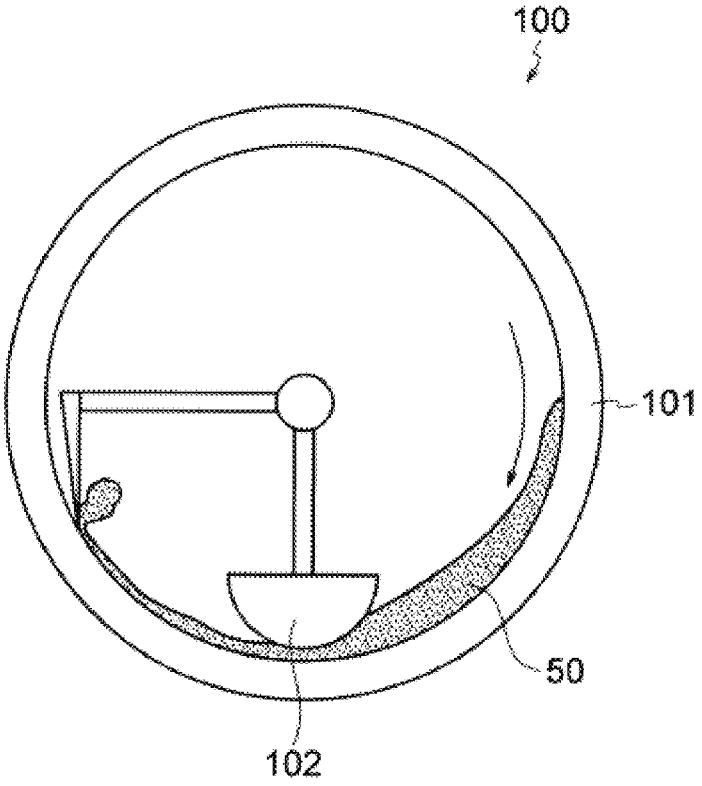
FIG. 4 is a schematic cross-sectional view showing a configuration of a powder coating device used for forming the coating portions.

In the embodiment, the coating portions can be formed by a mechanochemical coating method, a phosphate processing method, a sol-gel method or the like. In the mechanochemical coating method, for example, a powder coating device 100 shown in FIG. 4 is used. Mixture powder of the soft magnetic metal powder and powder-like coating materials of the material (compounds or the like of P, Si, Bi, and Zn) configuring the coating portions are fed into a container 101 of the powder coating device. After the feeding, a mixture 50 of the soft magnetic metal powder and the powder-like coating materials is compressed between a grinder 102 and an inner wall of the container 101 by rotating the container 101, and friction is generated to generate heat. The powder-like coating materials are softened by the generated friction heat and are fixed on the surfaces of the soft magnetic metal particles by a compression action, and the coating portions can be formed.

In the mechanochemical coating method, by adjusting a rotation rate of the container, a distance between the grinder and the inner wall of the container or the like, the generated friction heat can be controlled to control the temperature of the mixture of the soft magnetic metal powder and the powder-like coating materials. In the embodiment, the temperature is preferably 50° C. or higher and 150° C. or lower. The coating portions are formed easily in the manner of covering the surfaces of the soft magnetic metal particles by setting such a temperature range.

(4.2. Method for Producing Dust Core)

The dust core is produced using the above soft magnetic metal powder. The specific producing method is not particularly limited, and the publicly known method can be adopted. First, the soft magnetic metal powder including the soft magnetic metal particles on which the coating portions are formed and the publicly known resins serving as the binding agent are mixed to obtain a mixture. In addition, the obtained mixture may be formed into granulation powder as necessary. Then, the mixture or the granulation powder is filled into a press mold to be compressed and molded, and a molded body with a shape of the dust core to be made is obtained. The heat treatment is carried out to the obtained molded body at 50-200° C. for example, and thereby the resins are hardened and the dust core with the predetermined shape in which the soft magnetic metal particles are fixed via the resins is obtained. The magnetic component such as the inductor or the like is obtained by winding the wires for predetermined turns in the obtained dust core.

In addition, the above mixture or the granulation powder and an air core coil formed by winding the wires for predetermined turns may be filled into the press mold to be compressed and molded, and the molded body in which the coil is buried inside is obtained. The dust core with the predetermined shape in which the coil is buried is obtained by carrying out the heat treatment to the obtained molded body. Because the coil is buried inside, the dust core functions as the magnetic component such as the inductor or the like.

The embodiment of the present invention is described above, but the present invention is not limited to the above embodiment and may be changed in various aspects within the scope of the present invention.

Example

Next, examples are used to more specifically describe the invention, but the present invention is not limited to these examples.

(Experimental Samples 1-10)

Figure 5:
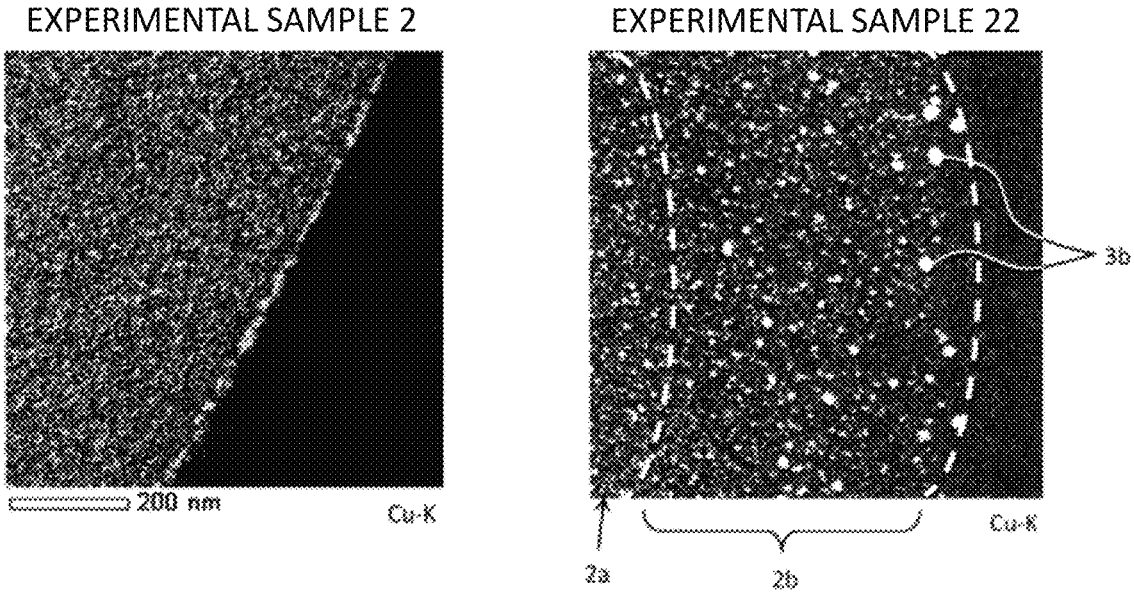
FIG. 5 is a mapping image of Cu near surfaces of the soft magnetic metal particles of experimental sample 2 and experimental sample 22 in examples of the present invention.

First, the powder including the particles configured by the soft magnetic alloy having the composition shown in table 1 and of which the average particle size D50 is the value shown in table 1 is prepared. The heat treatment is carried out under conditions shown in table 1 to the prepared powder, and the nanocrystals are deposited. A spectrum analysis of STEM-EELS is carried out to experimental sample 2 in a vicinity of the surfaces of the soft magnetic metal particle, and Cu is mapped. The results are shown in FIG. 5.

Next, the powder including the particles in which the nanocrystals are deposited is fed into the container of the powder coating device together with powder glass (a coating material) having a composition shown in table 1, and the powder glass is coated on the surfaces of the particles to form the coating portions, thereby obtaining the soft magnetic metal powder. An addition amount of the powder glass is set to 0.5 wt % with respect to 100 wt % of the powder including the particles in which the nanocrystals are deposited.

In the example, in $P_2O_5$—ZnO—$R_2O$—$Al_2O_3$ powder glass as phosphate-based glass, $P_2O_5$ is 50 wt %, ZnO is 12 wt %, $R_2O$ is 20 wt %, $Al_2O_3$ is 6 wt %, and the rest is accessory components.

Note that, the present inventors confirm that results the same as the results described later are obtained even when the same experiment is carried out on the glass having a composition in which $P_2O_5$ is 60 wt %, ZnO is 20 wt %, $R_2O$ is 10 wt %, $Al_2O_3$ is 5 wt %, and the rest is accessory components, and the glass having a composition in which $P_2O_5$ is 60 wt %, ZnO is 20 wt %, $R_2O$ is 10 wt %, $Al_2O_3$ is 5 wt %, and the rest is accessory components, or the like.

Then, the core portions, the first shell portions and the second shell portions are specified for the obtained soft magnetic metal powder, the average crystallite size of the Cu crystallites is measured in the core portions, the average crystallite size, the largest crystallite size and the average minor axis diameter of the Cu crystallites are calculated in the first shell portions, and a determination on whether Cu or Cu-containing oxide layers exist or not in the second shell portions is carried out.

As for the average crystallite size, the largest crystallite size and the average minor axis diameter of the crystallites, cross sections of the soft magnetic metal particles are observed using STEM-EDS at a magnification of 100,000-1,000,000, and in the core portions, 500 Cu crystallites are observed and areas of the crystallites are measured by the image processing software to calculate the equivalent circle diameters and set the equivalent circle diameters as the crystallite sizes of the crystallites. From the obtained crystallite sizes, the crystallite size having a cumulative distribution of 50% is set as the average crystallite size (D50). In addition, in the first shell portions, 100 Cu crystallites are observed and areas of the crystallites are measured by the image processing software to calculate the equivalent circle diameters and set the equivalent circle diameters as the crystallite sizes of the Cu crystallites. The largest crystallite size among the calculated crystallite sizes is set as the largest crystallite size. Further, in the first shell portions, contours of the observed Cu crystallites are extracted, and the shortest diameters among the diameters passing through the centers of the crystallites are set as the minor axis diameters. From the obtained minor axis diameters, the minor axis diameter having a cumulative distribution of 50% is set as the average minor axis diameter (D50). In addition, as for the crystallite sizes of Cu, 3DAP is used to measure the crystallite sizes of Cu under conditions equivalent to the above approach and calculate the average crystallite size or the like. The calculated results are the same as the results obtained by STEM-EDS. Further, the average crystallite size of the crystallites of Fe is calculated by XRD. The results are shown in table 1.

Next, an evaluation of the dust core is carried out. A total amount of an epoxy resin which is a thermosetting resin and an imide resin which is a hardening agent is weighed so as to be a value shown in table 1 with respect to 100 wt % of the obtained soft magnetic metal powder, the epoxy resin and the imide resin are added to acetone to be made into a solution, and the solution is mixed with the soft magnetic metal powder. After the mixing, granules obtained by volatilizing the acetone are sized with a mesh of 355 μm. The granules are filled into a press mold with a toroidal shape having an outer diameter of 11 mm and an inner diameter of 6.5 mm and are pressurized under a molding pressure of 3.0 t/cm$^2$ to obtain the molded body of the dust core. The resins in the obtained molded body of the dust core are hardened under the condition of 180° C. and 1 hour, and the dust core is obtained. In—Ga electrodes are formed at both ends of the dust core, a source meter is used to apply voltage on the top and the bottom of the samples of the dust core, and the withstand voltage is calculated from a voltage value when an electric current of 1 mA flows and the thickness (a distance between the electrodes) of the dust core. In the example, among samples in which the composition of the soft magnetic metal powder, the average particle size (D50), and the resin amount used at the time of forming the dust core are the same, samples showing a withstand voltage higher than the withstand voltage of the samples being the comparative examples are considered as good. The reason is that the withstand voltage varies with the difference in the resin amount. The results are shown in table 1.

TABLE 1

| | | Soft magnetic metal powder Soft magnetic metal particle | | | | | | | |
|---|---|---|---|---|---|---|---|---|---|
| | | | | Heat treatment conditions | | | | Entire particle Average | Core portion Average crystallite |
| Experimental No. | Comparative example/ example | Composition (at %) | Average particle size D50 (μm) | Holding temperature (° C.) | Holding time (min) | Temperature raising rate (° C./min) | Oxygen concentration (ppm) | crystallite size of Fe crystallites (nm) | size (A) of Cu crystallites (nm) |
| 1 | Comparative example | Fe73.5Cu1Nb3Si13.5B9 | 25 | 525 | 60 | 10 | 10 | 20.3 | 5.3 |
| 2 | Comparative example | Fe73.5Cu1Nb3Si13.5B9 | 25 | 525 | 60 | 10 | 10 | 20.3 | 5.3 |
| 3 | Example | Fe73.5Cu1Nb3Si13.5B9 | 25 | 525 | 60 | 10 | 100 | 20.7 | 5.2 |
| 4 | Example | Fe73.5Cu1Nb3Si13.5B9 | 25 | 525 | 60 | 10 | 200 | 21.0 | 5.2 |
| 5 | Example | Fe73.5Cu1Nb3Si13.5B9 | 25 | 525 | 60 | 10 | 400 | 21.5 | 5.4 |
| 6 | Example | Fe73.5Cu1Nb3Si13.5B9 | 25 | 525 | 60 | 10 | 1000 | 21.4 | 5.4 |
| 7 | Example | Fe73.5Cu1Nb3Si13.5B9 | 25 | 525 | 60 | 10 | 2000 | 21.3 | 5.5 |
| 8 | Example | Fe73.5Cu1Nb3Si13.5B9 | 25 | 525 | 60 | 10 | 5000 | 21.6 | 5.4 |
| 9 | Example | Fe73.5Cu1Nb3Si13.5B9 | 25 | 525 | 60 | 10 | 10000 | 21.5 | 5.6 |
| 10 | Example | Fe73.5Cu1Nb3Si13.5B9 | 25 | 525 | 60 | 10 | 20000 | 21.4 | 5.6 |

TABLE 1-continued

| | Soft magnetic metal powder | | | | | | | | |
|---|---|---|---|---|---|---|---|---|---|
| | Soft magnetic metal particle | | | | | | | | |
| | First shell portion | | | | | Second shell | | Dust core | |
| Experimental No. | Largest crystallite size (B) of Cu crystallites (nm) | Average crystallite size (C) of Cu crystallites (nm) | Average minor axis diameter (D) of Cu crystallites (nm) | C/A | B/A | portion layer including Cu or Cu oxide | Coating portion Coating material | Resin amount (wt %) | Property Withstand voltage (V/mm) |
| 1 | 7.2 | 5.8 | 4.3 | 1.1 | 1.4 | Observed | — | 2 | 36 |
| 2 | 7.2 | 5.8 | 4.3 | 1.1 | 1.4 | Observed | $P_2O_5$—ZnO—$R_2O$—$Al_2O_3$ | 2 | 267 |
| 3 | 15.5 | 8.3 | 5.6 | 1.6 | 3.0 | Observed | $P_2O_5$—ZnO—$R_2O$—$Al_2O_3$ | 2 | 355 |
| 4 | 25.0 | 10.3 | 8.3 | 2.0 | 4.8 | Observed | $P_2O_5$—ZnO—$R_2O$—$Al_2O_3$ | 2 | 430 |
| 5 | 36.0 | 20.4 | 14.5 | 3.8 | 6.7 | Observed | $P_2O_5$—ZnO—$R_2O$—$Al_2O_3$ | 2 | 533 |
| 6 | 39.3 | 25.3 | 17.8 | 4.7 | 7.3 | Observed | $P_2O_5$—ZnO—$R_2O$—$Al_2O_3$ | 2 | 641 |
| 7 | 45.2 | 30.2 | 24.4 | 5.5 | 8.2 | Observed | $P_2O_5$—ZnO—$R_2O$—$Al_2O_3$ | 2 | 456 |
| 8 | 73.2 | 50.2 | 43.2 | 9.3 | 13.6 | Observed | $P_2O_5$—ZnO—$R_2O$—$Al_2O_3$ | 2 | 403 |
| 9 | 102.1 | 78.4 | 67.3 | 14.0 | 18.2 | Observed | $P_2O_5$—ZnO—$R_2O$—$Al_2O_3$ | 2 | 398 |
| 10 | 120.3 | 93.2 | 84.5 | 16.6 | 21.5 | Observed | $P_2O_5$—ZnO—$R_2O$—$Al_2O_3$ | 2 | 378 |

According to table 1, it can be confirmed that, when B/A is within the above range, compared with an occasion that B/A falls out of the range, the withstand voltage is good. Note that, when B/A increases, the withstand voltage tends to decrease. It means that, when B/A is large, the Cu crystallites existing in the first shell portions are considerably grown than the Cu crystallites existing in the core portions.

Further, it can be confirmed that, when C/A is within the above range, compared with an occasion that C/A falls out of the range, the withstand voltage is good. When C/A increases, the withstand voltage tends to decrease. It means that, when C/A is large, the Cu crystallites existing in the first shell portions are considerably grown than the Cu crystallites existing in the core portions.

If the Cu crystallites grow too much, the Cu crystallites show a tendency to be deposited on the surface layers of the particles and are easily peeled from the particles at the time of forming the coating portions. If the grown Cu crystallites are peeled, the peeled Cu destroys the coating portions. As a result, it is considered that regions with a low insulation are formed and the withstand voltage of the dust core decreases.

(Experimental Samples 11-41)

Except that the heat treatment conditions in the samples of experimental sample 5 are set to the conditions shown in tables 2-4, the soft magnetic metal powder is made in the same way as experimental sample 5, and an evaluation the same as experimental sample 5 is carried out. In addition, the obtained powder is used to make a dust core in the same way as experimental sample 5, and an evaluation the same as the experimental sample 5 is carried out. The results are shown in table 2. Furthermore, for the samples of experimental sample 22, before the coating portions are formed, the spectrum analysis of STEM-EELS is carried out in the vicinity of the surfaces of the nanocrystal alloy particles, and Cu is mapped. The results are shown in FIG. 5.

TABLE 2

| | | | Soft magnetic metal powder Soft magnetic metal particle | | | | | | |
|---|---|---|---|---|---|---|---|---|---|
| | | | | Heat treatment conditions | | | | Entire particle Average | Core portion Average crystallite |
| Experimental No. | Comparative example/ example | Composition (at %) | Average particle size D50 (μm) | Holding temperature (° C.) | Holding time (min) | Temperature raising rate (° C./min) | Oxygen concentration (ppm) | crystallite size of Fe crystallites (nm) | size (A) of Cu crystallites (nm) |
| 11 | Comparative example | Fe73.5Cu1Nb3Si13.5B9 | 25 | 450 | 10 | 30 | 10 | 1.1 | 0.3 |
| 12 | Comparative example | Fe73.5Cu1Nb3Si13.5B9 | 25 | 475 | 10 | 30 | 10 | 5.0 | 1.4 |
| 13 | Comparative example | Fe73.5Cu1Nb3Si13.5B9 | 25 | 500 | 10 | 30 | 10 | 12.3 | 3.2 |
| 14 | Comparative example | Fe73.5Cu1Nb3Si13.5B9 | 25 | 525 | 10 | 30 | 10 | 19.5 | 5.2 |
| 15 | Comparative example | Fe73.5Cu1Nb3Si13.5B9 | 25 | 550 | 10 | 30 | 10 | 21.4 | 6.4 |
| 16 | Comparative example | Fe73.5Cu1Nb3Si13.5B9 | 25 | 575 | 10 | 30 | 10 | 23.1 | 8.3 |

TABLE 2-continued

| | | | | | | | | | |
|---|---|---|---|---|---|---|---|---|---|
| 17 | Comparative example | Fe73.5Cu1Nb3Si13.5B9 | 25 | 600 | 10 | 30 | 10 | 29.8 | 10.3 |
| 18 | Comparative example | Fe73.5Cu1Nb3Si13.5B9 | 25 | 625 | 10 | 30 | 10 | 40.3 | 14.3 |
| 19 | Example | Fe73.5Cu1Nb3Si13.5B9 | 25 | 450 | 10 | 30 | 400 | 1.2 | 0.2 |
| 20 | Example | Fe73.5Cu1Nb3Si13.5B9 | 25 | 475 | 10 | 30 | 400 | 4.3 | 1.1 |
| 21 | Example | Fe73.5Cu1Nb3Si13.5B9 | 25 | 500 | 10 | 30 | 400 | 11.2 | 2.1 |
| 22 | Example | Fe73.5Cu1Nb3Si13.5B9 | 25 | 525 | 10 | 30 | 400 | 18.3 | 4.8 |
| 23 | Example | Fe73.5Cu1Nb3Si13.5B9 | 25 | 550 | 10 | 30 | 400 | 21.1 | 5.8 |
| 24 | Example | Fe73.5Cu1Nb3Si13.5B9 | 25 | 575 | 10 | 30 | 400 | 22.3 | 7.8 |
| 25 | Example | Fe73.5Cu1Nb3Si13.5B9 | 25 | 600 | 10 | 30 | 400 | 25.7 | 9.3 |
| 26 | Example | Fe73.5Cu1Nb3Si13.5B9 | 25 | 625 | 10 | 30 | 400 | 30.7 | 14.1 |
| 27 | Example | Fe73.5Cu1Nb3Si13.5B9 | 25 | 450 | 60 | 10 | 400 | 1.1 | 0.3 |
| 28 | Example | Fe73.5Cu1Nb3Si13.5B9 | 25 | 475 | 60 | 10 | 400 | 4.8 | 1.3 |
| 29 | Example | Fe73.5Cu1Nb3Si13.5B9 | 25 | 500 | 60 | 10 | 400 | 12.4 | 3.1 |
| 5 | Example | Fe73.5Cu1Nb3Si13.5B9 | 25 | 525 | 60 | 10 | 400 | 21.5 | 5.4 |
| 30 | Example | Fe73.5Cu1Nb3Si13.5B9 | 25 | 550 | 60 | 10 | 400 | 22.3 | 6.6 |
| 31 | Example | Fe73.5Cu1Nb3Si13.5B9 | 25 | 575 | 60 | 10 | 400 | 24.1 | 8.5 |
| 32 | Example | Fe73.5Cu1Nb3Si13.5B9 | 25 | 600 | 60 | 10 | 400 | 29.8 | 10.7 |
| 33 | Example | Fe73.5Cu1Nb3Si13.5B9 | 25 | 625 | 60 | 10 | 400 | 41.3 | 14.7 |
| 34 | Example | Fe73.5Cu1Nb3Si13.5B9 | 25 | 450 | 600 | 10 | 400 | 1.3 | 0.2 |
| 35 | Example | Fe73.5Cu1Nb3Si13.5B9 | 25 | 475 | 600 | 10 | 400 | 4.1 | 1.3 |
| 36 | Example | Fe73.5Cu1Nb3Si13.5B9 | 25 | 500 | 600 | 10 | 400 | 12.8 | 3.3 |
| 37 | Example | Fe73.5Cu1Nb3Si13.5B9 | 25 | 525 | 600 | 10 | 400 | 22.5 | 5.7 |
| 38 | Example | Fe73.5Cu1Nb3Si13.5B9 | 25 | 550 | 600 | 10 | 400 | 23.1 | 6.9 |
| 39 | Example | Fe73.5Cu1Nb3Si13.5B9 | 25 | 575 | 600 | 10 | 400 | 25.3 | 8.8 |
| 40 | Example | Fe73.5Cu1Nb3Si13.5B9 | 25 | 600 | 600 | 10 | 400 | 30.1 | 10.9 |
| 41 | Example | Fe73.5Cu1Nb3Si13.5B9 | 25 | 625 | 600 | 10 | 400 | 42.3 | 15.1 |

| | Soft magnetic metal powder | | | | | | | | |
|---|---|---|---|---|---|---|---|---|---|
| | Soft magnetic metal particle | | | | | | | | |
| | First shell portion | | | | | Second shell | | Dust core | |
| Experimental No. | Largest crystallite size (B) of Cu crystallites (nm) | Average crystallite size (C) of Cu crystallites (nm) | Average minor axis diameter (D) of Cu crystallites (nm) | C/A | B/A | portion layer including Cu or Cu oxide | Coating portion Coating material | Resin amount (wt %) | Property Withstand voltage (V/mm) |
| 11 | 0.4 | 0.3 | 0.2 | 1.0 | 1.3 | Not observed | $P_2O_5$—ZnO—$R_2O$—$Al_2O_3$ | 2 | 231 |
| 12 | 1.8 | 1.6 | 1.3 | 1.1 | 1.3 | Not observed | $P_2O_5$—ZnO—$R_2O$—$Al_2O_3$ | 2 | 241 |
| 13 | 3.9 | 3.4 | 3.0 | 1.1 | 1.2 | Not observed | $P_2O_5$—ZnO—$R_2O$—$Al_2O_3$ | 2 | 244 |
| 14 | 6.7 | 5.3 | 4.9 | 1.0 | 1.3 | Not observed | $P_2O_5$—ZnO—$R_2O$—$Al_2O_3$ | 2 | 254 |
| 15 | 7.9 | 6.5 | 5.6 | 1.0 | 1.2 | Not observed | $P_2O_5$—ZnO—$R_2O$—$Al_2O_3$ | 2 | 234 |
| 16 | 11.2 | 9.1 | 7.5 | 1.1 | 1.3 | Not observed | $P_2O_5$—ZnO—$R_2O$—$Al_2O_3$ | 2 | 254 |
| 17 | 13.5 | 10.6 | 8.4 | 1.0 | 1.3 | Not observed | $P_2O_5$—ZnO—$R_2O$—$Al_2O_3$ | 2 | 234 |
| 18 | 19.3 | 14.5 | 12.3 | 1.0 | 1.3 | Not observed | $P_2O_5$—ZnO—$R_2O$—$Al_2O_3$ | 2 | 246 |
| 19 | 9.3 | 4.8 | 3.8 | 24.0 | 46.5 | Not observed | $P_2O_5$—ZnO—$R_2O$—$Al_2O_3$ | 2 | 321 |
| 20 | 11.3 | 5.3 | 4.2 | 4.8 | 10.3 | Not observed | $P_2O_5$—ZnO—$R_2O$—$Al_2O_3$ | 2 | 345 |
| 21 | 23.1 | 13.1 | 6.5 | 6.2 | 11.0 | Not observed | $P_2O_5$—ZnO—$R_2O$—$Al_2O_3$ | 2 | 367 |
| 22 | 31.2 | 19.2 | 13.2 | 4.0 | 6.5 | Not observed | $P_2O_5$—ZnO—$R_2O$—$Al_2O_3$ | 2 | 393 |
| 23 | 36.3 | 22.1 | 15.3 | 3.8 | 6.3 | Not observed | $P_2O_5$—ZnO—$R_2O$—$Al_2O_3$ | 2 | 483 |
| 24 | 44.6 | 26.7 | 17.8 | 3.4 | 5.7 | Not observed | $P_2O_5$—ZnO—$R_2O$—$Al_2O_3$ | 2 | 456 |
| 25 | 55.3 | 29.1 | 23.5 | 3.1 | 5.9 | Not observed | $P_2O_5$—ZnO—$R_2O$—$Al_2O_3$ | 2 | 432 |
| 26 | 73.1 | 31.2 | 28.4 | 2.2 | 5.2 | Not observed | $P_2O_5$—ZnO—$R_2O$—$Al_2O_3$ | 2 | 333 |
| 27 | 8.8 | 5.8 | 6.5 | 19.3 | 29.3 | Observed | $P_2O_5$—ZnO—$R_2O$—$Al_2O_3$ | 2 | 421 |
| 28 | 12.1 | 8.3 | 5.6 | 6.4 | 9.3 | Observed | $P_2O_5$—ZnO—$R_2O$—$Al_2O_3$ | 2 | 432 |
| 29 | 24.2 | 14.1 | 7.4 | 4.5 | 7.8 | Observed | $P_2O_5$—ZnO—$R_2O$—$Al_2O_3$ | 2 | 478 |
| 5 | 36.0 | 20.4 | 14.5 | 3.8 | 6.7 | Observed | $P_2O_5$—ZnO—$R_2O$—$Al_2O_3$ | 2 | 533 |
| 30 | 39.3 | 23.1 | 14.6 | 3.5 | 6.0 | Observed | $P_2O_5$—ZnO—$R_2O$—$Al_2O_3$ | 2 | 554 |
| 31 | 40.5 | 28.9 | 15.3 | 3.4 | 4.8 | Observed | $P_2O_5$—ZnO—$R_2O$—$Al_2O_3$ | 2 | 433 |
| 32 | 58.9 | 32.1 | 48.2 | 3.0 | 5.5 | Observed | $P_2O_5$—ZnO—$R_2O$—$Al_2O_3$ | 2 | 421 |
| 33 | 78.3 | 42.1 | 57.3 | 2.9 | 5.3 | Observed | $P_2O_5$—ZnO—$R_2O$—$Al_2O_3$ | 2 | 367 |
| 34 | 194 | 31 | 6.5 | 153.0 | 970 | Observed | $P_2O_5$—ZnO—$R_2O$—$Al_2O_3$ | 2 | 343 |
| 35 | 201 | 38 | 5.6 | 29.3 | 155 | Observed | $P_2O_5$—ZnO—$R_2O$—$Al_2O_3$ | 2 | 343 |
| 36 | 231 | 42 | 7.4 | 12.7 | 70.0 | Observed | $P_2O_5$—ZnO—$R_2O$—$Al_2O_3$ | 2 | 354 |
| 37 | 255 | 45 | 14.5 | 7.9 | 44.7 | Observed | $P_2O_5$—ZnO—$R_2O$—$Al_2O_3$ | 2 | 321 |
| 38 | 267 | 49 | 14.6 | 7.1 | 38.7 | Observed | $P_2O_5$—ZnO—$R_2O$—$Al_2O_3$ | 2 | 342 |
| 39 | 283 | 52 | 15.3 | 5.9 | 32.2 | Observed | $P_2O_5$—ZnO—$R_2O$—$Al_2O_3$ | 2 | 345 |
| 40 | 301 | 59 | 48.2 | 5.4 | 27.6 | Observed | $P_2O_5$—ZnO—$R_2O$—$Al_2O_3$ | 2 | 312 |
| 41 | 354 | 60 | 57.3 | 4.0 | 23.4 | Observed | $P_2O_5$—ZnO—$R_2O$—$Al_2O_3$ | 2 | 308 |

According to table 2, it can be confirmed that when the oxygen concentration is 10 ppm, even if the other heat treatment conditions are changed, coarse Cu crystallites are not deposited on the surface sides of the particles, B/A falls out of the range of the present invention and the withstand voltage of the dust core decreases.

It can be confirmed that when the oxygen concentration is 400 ppm, by changing the other heat treatment conditions, the deposition of the coarse Cu crystallites on the surface sides of the particles is controlled, and B/A changes within the range of the present invention. Specifically, it can be confirmed that when the holding temperature is low, the holding time is long, and the temperature raising rate is slow, B/A tends to increase.

In addition, according to FIG. 5, it can be confirmed that the size and the existing state of the Cu crystallites are different on the center side and the surface side of the soft magnetic metal particle by making the heat treatment conditions, particularly the oxygen concentration be a proper concentration.

(Experimental Samples 42-43)

Except that the coating material having the composition shown in table 3 is used to form the coating portions in the samples of experimental sample 5, the soft magnetic metal powder is made in the same way as experimental sample 5, and an evaluation the same as experimental sample 5 is carried out. In addition, the obtained powder is used to make the dust core in the same way as experimental sample 5, and the evaluation the same as experimental sample 5 is carried out. The results are shown in table 3.

According to table 3, it can be confirmed that when B/A is within the above range, regardless of the composition of the coating material, the withstand voltage of the dust core is good.

In addition, in the example, in $Bi_2O_3$—ZnO—$B_2O_3$—$SiO_2$ powder glass as the bismuth salt glass, $Bi_2O_3$ is 80 wt %, ZnO is 10 wt %, $B_2O_3$ is 5 wt %, and $SiO_2$ is 5 wt %. It is confirmed that when the same experiment is also carried out on the glass serving as the bismuth salt glass and having other compositions, the same results as the results described later are obtained.

Further, in the example, in BaO—ZnO—$B_2O_3$—$SiO_2$—$Al_2O_3$ powder glass as the borosilicate glass, BaO is 8 wt %, ZnO is 23 wt %, $B_2O_3$ is 19 wt %, $SiO_2$ is 16 wt %, $Al_2O_3$ is 6 wt %, and the rest is accessory components. It is confirmed that when the same experiment is also carried out on the glass serving as the borosilicate glass and having other compositions, and the same results as the results described later are obtained.

(Experimental Samples 44-49)

Except that the average particle size D50 of the powder in experimental samples 2 and 5 is set to the values shown in table 4, the soft magnetic metal powder is made in the same way as experimental samples 2 and 5, and an evaluation the same as experimental samples 2 and 5 is carried out. In addition, the obtained powder is used to make the dust core in the same way as experimental samples 2 and 5, and the evaluation the same as experimental samples 2 and 5 is carried out. The results are shown in table 4.

TABLE 3

| | | Soft magnetic metal powder Soft magnetic metal particle | | | | | | | |
|---|---|---|---|---|---|---|---|---|---|
| | | | | Heat treatment conditions | | | | Entire particle Average | Core portion Average crystallite |
| Experimental No. | Comparative example/example | Composition (at %) | Average particle size D50 (μm) | Holding temperature (° C.) | Holding time (min) | Temperature raising rate (° C./min) | Oxygen concentration (ppm) | crystallite size of Fe crystallites (nm) | size (A) of Cu crystallites (nm) |
| 5 | Example | Fe73.5Cu1Nb3Si13.5B9 | 25 | 525 | 60 | 10 | 400 | 21.5 | 5.4 |
| 42 | Example | Fe73.5Cu1Nb3Si13.5B9 | 25 | 525 | 60 | 10 | 400 | 21.5 | 5.4 |
| 43 | Example | Fe73.5Cu1Nb3Si13.5B9 | 25 | 525 | 60 | 10 | 400 | 21.5 | 5.5 |

| | Soft magnetic metal powder | | | | | | | | |
|---|---|---|---|---|---|---|---|---|---|
| | Soft magnetic metal particle | | | | | | | | |
| | First shell portion | | | | | | | | |
| Experimental No. | Largest crystallite size (B) of Cu crystallites (nm) | Average crystallite size (C) of Cu crystallites (nm) | Average minor axis diameter (D) of Cu crystallites (nm) | C/A | B/A | Second shell portion layer including Cu or Cu oxide | Coating portion Coating material | Dust core Resin amount (wt %) | Dust core Property Withstand voltage (V/mm) |
| 5 | 36.0 | 20.4 | 14.5 | 3.8 | 6.7 | Observed | $P_2O_5$—ZnO—$R_2O$—$Al_2O_3$ | 2 | 533 |
| 42 | 36.0 | 20.4 | 14.5 | 3.8 | 6.7 | Observed | $Bi_2O_3$—ZnO—$B_2O_3$—$SiO_2$ | 2 | 502 |
| 43 | 36.0 | 20.4 | 14.5 | 3.7 | 6.5 | Observed | BaO—ZnO—$B_2O_3$—$SiO_2$—$Al_2O_3$ | 2 | 563 |

TABLE 4

| | | Soft magnetic metal powder Soft magnetic metal particle | | | | | | | |
|---|---|---|---|---|---|---|---|---|---|
| | | | | Heat treatment conditions | | | | Entire particle Average | Core portion Average crystallite |
| Experimental No. | Comparative example/ example | Composition (at %) | Average particle size D50 (μm) | Holding temperature (° C.) | Holding time (min) | Temperature raising rate (° C./min) | Oxygen concentration (ppm) | crystallite size of Fe crystallites (nm) | size (A) of Cu crystallites (nm) |
| 44 | Comparative example | Fe73.5Cu1Nb3Si13.5B9 | 5 | 525 | 60 | 10 | 10 | 21.0 | 5.2 |
| 45 | Comparative example | Fe73.5Cu1Nb3Si13.5B9 | 10 | 525 | 60 | 10 | 10 | 21.5 | 5.2 |
| 2 | Comparative example | Fe73.5Cu1Nb3Si13.5B9 | 25 | 525 | 60 | 10 | 10 | 20.3 | 5.3 |
| 46 | Comparative example | Fe73.5Cu1Nb3Si13.5B9 | 50 | 525 | 60 | 10 | 10 | 20.4 | 5.5 |
| 47 | Example | Fe73.5Cu1Nb3Si13.5B9 | 5 | 525 | 60 | 10 | 400 | 21.5 | 5.3 |
| 48 | Example | Fe73.5Cu1Nb3Si13.5B9 | 10 | 525 | 60 | 10 | 400 | 22.1 | 5.3 |
| 5 | Example | Fe73.5Cu1Nb3Si13.5B9 | 25 | 525 | 60 | 10 | 400 | 21.5 | 5.4 |
| 49 | Example | Fe73.5Cu1Nb3Si13.5B9 | 50 | 525 | 60 | 10 | 400 | 23.1 | 5.5 |

| | Soft magnetic metal powder | | | | | | | | |
|---|---|---|---|---|---|---|---|---|---|
| | Soft magnetic metal particle | | | | | | | | |
| | First shell portion | | | | | Second shell | | Dust core | |
| Experimental No. | Largest crystallite size (B) of Cu crystallites (nm) | Average crystallite size (C) of Cu crystallites (nm) | Average minor axis diameter (D) of Cu crystallites (nm) | C/A | B/A | portion layer including Cu or Cu oxide | Coating portion Coating material | Resin amount (wt %) | Property Withstand voltage (V/mm) |
| 44 | 7.1 | 5.4 | 4.1 | 1.0 | 1.4 | Observed | $P_2O_5$—ZnO—$R_2O$— $Al_2O_3$ | 3 | 204 |
| 45 | 7.3 | 5.6 | 4.2 | 1.1 | 1.4 | Observed | $P_2O_5$—ZnO—$R_2O$— $Al_2O_3$ | 2 | 156 |
| 2 | 7.2 | 5.8 | 4.3 | 1.1 | 1.4 | Observed | $P_2O_5$—ZnO—$R_2O$— $Al_2O_3$ | 2 | 267 |
| 46 | 7.5 | 5.9 | 4.8 | 1.1 | 1.4 | Observed | $P_2O_5$—ZnO—$R_2O$— $Al_2O_3$ | 2 | 143 |
| 47 | 37.2 | 20.1 | 13.8 | 3.8 | 7.0 | Observed | $P_2O_5$—ZnO—$R_2O$— $Al_2O_3$ | 3 | 306 |
| 48 | 36.4 | 20.4 | 14.6 | 3.8 | 6.9 | Observed | $P_2O_5$—ZnO—$R_2O$— $Al_2O_3$ | 2 | 321 |
| 5 | 36.0 | 20.4 | 14.5 | 3.8 | 6.7 | Observed | $P_2O_5$—ZnO—$R_2O$— $Al_2O_3$ | 2 | 533 |
| 49 | 37.9 | 20.5 | 14.2 | 3.7 | 6.9 | Observed | $P_2O_5$—ZnO—$R_2O$— $Al_2O_3$ | 2 | 345 |

According to table 4, it can be confirmed that when B/A is within the above range, the withstand voltage of the dust core is good regardless of the average particle size D50 of the powder.

Note that, with respect to 100 wt % of the powder including the particles in which the nanocrystals are deposited, when the average particle size (D50) of the powder is 5 μm and 10 μm, the addition amount of the powder glass is set to 1 wt %, and when the average particle size (D50) of the powder is 25 μm and 50 μm, the addition amount of the powder glass is set to 0.5 wt %. A powder glass amount required for forming a predetermined thickness varies with the particle diameters of the soft magnetic metal powder on which the coating portions are formed.

(Experimental Sample 50-181)

Except that the heat treatment is carried out under the conditions shown in tables 5 to 8 to the powder which includes the particles configured by the soft magnetic alloy having the composition shown in tables 5 to 8 and of which the average particle size D50 is the value shown tables 5 to 8, and the nanocrystals are deposited, the soft magnetic metal powder is made in the same way as experimental samples 1-10, and an evaluation the same as experimental sample 5 is carried out. In addition, the obtained powder is used to make the dust core in the same way as experimental sample 5, and the evaluation the same as experimental sample 5 is carried out. The results are shown in tables 5 to 8.

TABLE 5

| | | Soft magnetic metal powder Soft magnetic metal particle | | | | | | | |
|---|---|---|---|---|---|---|---|---|---|
| | | | | Heat treatment conditions | | | | Entire particle Average | Core portion Average crystallite |
| Experimental No. | Comparative example/ Example | Composition (at %) | Average particle size D50 (μm) | Holding temperature (° C.) | Holding time (min) | Temperature raising rate (° C./min) | Oxygen concentration (ppm) | crystallite size of Fe crystallites (nm) | size (A) of Cu crystallites (nm) |
| 5 | Example | Fe73.5Cu1Nb3Si13.5B9 | 25 | 525 | 60 | 10 | 400 | 21.5 | 5.4 |
| 50 | Example | Fe77.5Cu1Nb3Si13.5B5 | 25 | 525 | 60 | 10 | 400 | 44.0 | 5.5 |
| 51 | Example | Fe75.5Cu1Nb3Si13.5B7 | 25 | 525 | 60 | 10 | 400 | 21.0 | 5.5 |
| 52 | Example | Fe71.5Cu1Nb3Si13.5B11 | 25 | 525 | 60 | 10 | 400 | 22.0 | 5.0 |
| 53 | Example | Fe69.5Cu1Nb3Si13.5B13 | 25 | 525 | 60 | 10 | 400 | 23.0 | 4.9 |
| 54 | Example | Fe74.4Cu0.1Nb3Si13.5B9 | 25 | 525 | 60 | 10 | 400 | 32.0 | 5.6 |
| 55 | Example | Fe71.5Cu3Nb3Si13.5B9 | 25 | 525 | 60 | 10 | 400 | 14.0 | 5.6 |
| 56 | Example | Fe79.5Cu1Nb3Si9.5B9 | 25 | 525 | 60 | 10 | 400 | 64.0 | 5.5 |
| 57 | Example | Fe75.5Cu1Nb3Si11.5B9 | 25 | 525 | 60 | 10 | 400 | 22.0 | 5.8 |
| 58 | Example | Fe73.5Cu1Nb3Si15.5B7 | 25 | 525 | 60 | 10 | 400 | 22.0 | 5.2 |
| 59 | Example | Fe71.5Cu1Nb3Si15.5B9 | 25 | 525 | 60 | 10 | 400 | 21.0 | 5.8 |
| 60 | Example | Fe69.5Cu1Nb3Si17.5B9 | 25 | 525 | 60 | 10 | 400 | 24.0 | 5.8 |
| 61 | Example | Fe75.5Cu1Nb1Si13.5B9 | 25 | 525 | 60 | 10 | 400 | 21.0 | 5.0 |
| 62 | Example | Fe71.5Cu1Nb5Si13.5B9 | 25 | 525 | 60 | 10 | 400 | 22.0 | 5.0 |
| 63 | Example | Fe66.5Cu1Nb10Si13.5B9 | 25 | 525 | 60 | 10 | 400 | 23.0 | 4.9 |
| 64 | Example | Fe73.5Cu1Ti3Si13.5B9 | 25 | 525 | 60 | 10 | 400 | 21.0 | 5.3 |
| 65 | Example | Fe73.5Cu1Zr3Si13.5B9 | 25 | 525 | 60 | 10 | 400 | 22.0 | 5.4 |
| 66 | Example | Fe73.5Cu1Hf3Si13.5B9 | 25 | 525 | 60 | 10 | 400 | 22.0 | 5.0 |
| 67 | Example | Fe73.5Cu1V3Si13.5B9 | 25 | 525 | 60 | 10 | 400 | 22.0 | 5.9 |
| 68 | Example | Fe73.5Cu1Ta3Si13.5B9 | 25 | 525 | 60 | 10 | 400 | 21.0 | 5.3 |
| 69 | Example | Fe73.5Cu1Mo3Si13.5B9 | 25 | 525 | 60 | 10 | 400 | 23.0 | 5.8 |
| 70 | Example | Fe73.5Cu1Hf1.5Nb1.5Si13.5B9 | 25 | 525 | 60 | 10 | 400 | 23.0 | 5.7 |
| 71 | Example | Fe79.5Cu1Nb2Si9.5B9C1 | 25 | 525 | 60 | 10 | 400 | 23.0 | 5.8 |
| 72 | Example | Fe79Cu1Nb2Si9B5C4 | 25 | 525 | 60 | 10 | 400 | 23.0 | 5.5 |
| 73 | Example | Fe73.5Cu1Nb3Si13.5B8C1 | 25 | 525 | 60 | 10 | 400 | 23.0 | 5.6 |
| 74 | Example | Fe73.5Cu1Nb3Si13.5B5C4 | 25 | 525 | 60 | 10 | 400 | 21.0 | 5.3 |
| 75 | Example | Fe69.5Cu1Nb3Si17.5B8C1 | 25 | 525 | 60 | 10 | 400 | 21.0 | 5.2 |
| 76 | Example | Fe69.5Cu1Nb3Si17.5B5C4 | 25 | 525 | 60 | 10 | 400 | 19.0 | 5.6 |

| | Soft magnetic metal powder | | | | | | | | |
|---|---|---|---|---|---|---|---|---|---|
| | Soft magnetic metal particle | | | | | | | | |
| | First shell portion | | | | | Second shell | | Dust core | |
| Experimental No. | Largest crystallite size (B) of Cu crystallites (nm) | Average crystallite size (C) of Cu crystallites (nm) | Average minor axis diameter (D) of Cu crystallites (nm) | C/A | B/A | portion layer including Cu or Cu oxide | Coating portion Coating material | Resin amount (wt %) | Property Withstand voltage (V/mm) |
| 5 | 36.0 | 20.4 | 14.5 | 3.8 | 6.7 | Observed | $P_2O_5$—ZnO—$R_2O$—$Al_2O_3$ | 2 | 533 |
| 50 | 34.2 | 19.0 | 15.8 | 3.4 | 6.2 | Observed | $P_2O_5$—ZnO—$R_2O$—$Al_2O_3$ | 2 | 506 |
| 51 | 37.4 | 21.0 | 13.1 | 3.9 | 6.9 | Observed | $P_2O_5$—ZnO—$R_2O$—$Al_2O_3$ | 2 | 554 |
| 52 | 35.3 | 19.2 | 14.9 | 3.9 | 7.1 | Observed | $P_2O_5$—ZnO—$R_2O$—$Al_2O_3$ | 2 | 512 |
| 53 | 37.1 | 19.6 | 14.8 | 4.0 | 7.5 | Observed | $P_2O_5$—ZnO—$R_2O$—$Al_2O_3$ | 2 | 517 |
| 54 | 36.7 | 21.6 | 15.2 | 3.9 | 6.6 | Observed | $P_2O_5$—ZnO—$R_2O$—$Al_2O_3$ | 2 | 522 |
| 55 | 37.1 | 20.6 | 15.4 | 3.7 | 6.6 | Observed | $P_2O_5$—ZnO—$R_2O$—$Al_2O_3$ | 2 | 522 |
| 56 | 37.1 | 21.4 | 15.4 | 3.9 | 6.7 | Observed | $P_2O_5$—ZnO—$R_2O$—$Al_2O_3$ | 2 | 517 |
| 57 | 38.9 | 18.8 | 14.8 | 3.2 | 6.7 | Observed | $P_2O_5$—ZnO—$R_2O$—$Al_2O_3$ | 2 | 506 |
| 58 | 32.8 | 20.8 | 15.2 | 4.0 | 6.3 | Observed | $P_2O_5$—ZnO—$R_2O$—$Al_2O_3$ | 2 | 522 |
| 59 | 36.7 | 19.8 | 14.9 | 3.4 | 6.3 | Observed | $P_2O_5$—ZnO—$R_2O$—$Al_2O_3$ | 2 | 517 |
| 60 | 33.8 | 21.4 | 13.3 | 3.7 | 5.8 | Observed | $P_2O_5$—ZnO—$R_2O$—$Al_2O_3$ | 2 | 512 |
| 61 | 35.3 | 21.0 | 15.1 | 4.2 | 7.0 | Observed | $P_2O_5$—ZnO—$R_2O$—$Al_2O_3$ | 2 | 506 |
| 62 | 34.2 | 22.4 | 14.4 | 4.5 | 6.9 | Observed | $P_2O_5$—ZnO—$R_2O$—$Al_2O_3$ | 2 | 554 |
| 63 | 33.8 | 22.0 | 13.2 | 4.5 | 7.0 | Observed | $P_2O_5$—ZnO—$R_2O$—$Al_2O_3$ | 2 | 506 |
| 64 | 32.8 | 21.2 | 14.2 | 4.0 | 6.1 | Observed | $P_2O_5$—ZnO—$R_2O$—$Al_2O_3$ | 2 | 560 |
| 65 | 39.2 | 21.2 | 13.2 | 3.9 | 7.3 | Observed | $P_2O_5$—ZnO—$R_2O$—$Al_2O_3$ | 2 | 528 |
| 66 | 38.2 | 21.0 | 15.7 | 4.2 | 7.7 | Observed | $P_2O_5$—ZnO—$R_2O$—$Al_2O_3$ | 2 | 533 |
| 67 | 38.9 | 19.2 | 14.9 | 3.3 | 6.6 | Observed | $P_2O_5$—ZnO—$R_2O$—$Al_2O_3$ | 2 | 522 |
| 68 | 36.7 | 22.0 | 15.2 | 4.2 | 6.9 | Observed | $P_2O_5$—ZnO—$R_2O$—$Al_2O_3$ | 2 | 528 |
| 69 | 37.4 | 20.8 | 15.5 | 3.6 | 6.4 | Observed | $P_2O_5$—ZnO—$R_2O$—$Al_2O_3$ | 2 | 528 |
| 70 | 37.8 | 20.2 | 13.8 | 3.5 | 6.6 | Observed | $P_2O_5$—ZnO—$R_2O$—$Al_2O_3$ | 2 | 544 |
| 71 | 39.2 | 21.6 | 15.5 | 3.7 | 6.8 | Observed | $P_2O_5$—ZnO—$R_2O$—$Al_2O_3$ | 2 | 522 |
| 72 | 38.2 | 18.4 | 13.2 | 3.4 | 7.0 | Observed | $P_2O_5$—ZnO—$R_2O$—$Al_2O_3$ | 2 | 517 |
| 73 | 34.9 | 22.2 | 15.8 | 4.0 | 6.3 | Observed | $P_2O_5$—ZnO—$R_2O$—$Al_2O_3$ | 2 | 522 |

TABLE 5-continued

| | | | | | | | | | | |
|---|---|---|---|---|---|---|---|---|---|---|
| | 74 | 33.8 | 19.2 | 14.8 | 3.6 | 6.4 | Observed | $P_2O_5$—ZnO—$R_2O$—$Al_2O_3$ | 2 | 538 |
| | 75 | 39.2 | 19.6 | 14.8 | 3.8 | 7.6 | Observed | $P_2O_5$—ZnO—$R_2O$—$Al_2O_3$ | 2 | 549 |
| | 76 | 39.2 | 21.0 | 14.2 | 3.8 | 7.1 | Observed | $P_2O_5$—ZnO—$R_2O$—$Al_2O_3$ | 2 | 544 |

TABLE 6

| | | Soft magnetic metal powder Soft magnetic metal particle | | | | | | | |
|---|---|---|---|---|---|---|---|---|---|
| | | | | Heat treatment conditions | | | | Entire particle Average | Core portion Average crystallite |
| Experimental No. | Comparative example/example | Composition (at %) | Average particle size D50 (μm) | Holding temperature (° C.) | Holding time (min) | Temperature raising rate (° C./min) | Oxygen concentration (ppm) | crystallite size of Fe crystallites (nm) | size (A) of Cu crystallites (nm) |
| 77 | Example | Fe89Zr7B3Cu1 | 25 | 600 | 60 | 10 | 400 | 7.0 | 5.2 |
| 78 | Example | Fe88Hf7B3Cu1 | 25 | 600 | 60 | 10 | 400 | 6.0 | 5.3 |
| 79 | Example | Fe84Nb3.5Zr3.5B8Cu1 | 25 | 600 | 60 | 10 | 400 | 7.0 | 5.6 |
| 80 | Example | Fe84Nb3.5Hf3.5B8Cu1 | 25 | 600 | 60 | 10 | 400 | 7.0 | 5.2 |
| 81 | Example | Fe90.9Nb6B3Cu0.1 | 25 | 600 | 60 | 10 | 400 | 7.0 | 5.6 |
| 82 | Example | Fe84Nb3.5Ti3.5B8Cu1 | 25 | 600 | 60 | 10 | 400 | 6.0 | 5.6 |
| 83 | Example | Fe84Nb3.5Ta3.5B8Cu1 | 25 | 600 | 60 | 10 | 400 | 7.0 | 5.6 |
| 84 | Example | Fe84Nb3.5Mo3.5B8Cu1 | 25 | 600 | 60 | 10 | 400 | 7.0 | 5.1 |
| 85 | Example | Fe84Nb3.5W3.5B8Cu1 | 25 | 600 | 60 | 10 | 400 | 7.0 | 5.8 |
| 86 | Example | Fe84Nb3.5Al3.5B8Cu1 | 25 | 600 | 60 | 10 | 400 | 7.0 | 5.9 |
| 87 | Example | Fe86.6Nb3.2B10Cu0.1C0.1 | 25 | 600 | 60 | 10 | 400 | 21.0 | 5.9 |
| 88 | Example | Fe75.8Nb14B10Cu0.1C0.1 | 25 | 600 | 60 | 10 | 400 | 15.0 | 5.1 |
| 89 | Example | Fe89.8Nb7B3Cu0.1C0.1 | 25 | 600 | 60 | 10 | 400 | 9.0 | 5.0 |
| 90 | Example | Fe72.8Nb7B20Cu0.1C0.1 | 25 | 600 | 60 | 10 | 400 | 15.0 | 5.5 |
| 91 | Example | Fe80.8Nb3.2B10Cu3C3 | 25 | 600 | 60 | 10 | 400 | 16.0 | 5.6 |
| 92 | Example | Fe70Nb14B10Cu3C3 | 25 | 600 | 60 | 10 | 400 | 13.0 | 5.0 |
| 93 | Example | Fe84Nb7B3Cu3C3 | 25 | 600 | 60 | 10 | 400 | 9.0 | 5.8 |
| 94 | Example | Fe67Nb7B20Cu3C3 | 25 | 600 | 60 | 10 | 400 | 11.0 | 5.6 |
| 95 | Example | Fe85Nb3B10Cu1C1 | 25 | 600 | 60 | 10 | 400 | 8.0 | 5.9 |
| 96 | Example | Fe84.8Nb3.2B10Cu1C1 | 25 | 600 | 60 | 10 | 400 | 12.0 | 5.9 |
| 97 | Example | Fe83Nb5B10Cu1C1 | 25 | 600 | 60 | 10 | 400 | 11.0 | 5.4 |
| 98 | Example | Fe81Nb7B10Cu1C1 | 25 | 600 | 60 | 10 | 400 | 8.0 | 5.6 |
| 99 | Example | Fe78Nb10B10Cu1C1 | 25 | 600 | 60 | 10 | 400 | 9.0 | 5.7 |
| 100 | Example | Fe76Nb12B10Cu1C1 | 25 | 600 | 60 | 10 | 400 | 10.0 | 5.3 |
| 101 | Example | Fe74Nb14B10Cu1C1 | 25 | 600 | 60 | 10 | 400 | 9.0 | 5.1 |
| 102 | Example | Fe75.8Nb14B10Cr0.1Cu0.1 | 25 | 600 | 60 | 10 | 400 | 8.0 | 5.2 |
| 103 | Example | Fe82.8Nb7B10Cr0.1Cu0.1 | 25 | 600 | 60 | 10 | 400 | 8.0 | 5.2 |
| 104 | Example | Fe86.8Nb3B10Cr0.1Cu0.1 | 25 | 600 | 60 | 10 | 400 | 12.0 | 5.1 |
| 105 | Example | Fe72.8Nb7B20Cr0.1Cu0.1 | 25 | 600 | 60 | 10 | 400 | 7.0 | 5.6 |
| 106 | Example | Fe89.8Nb7B3Cr0.1Cu0.1 | 25 | 600 | 60 | 10 | 400 | 6.0 | 4.9 |
| 107 | Example | Fe73Nb14B10Cr1.5Cu1.5 | 25 | 600 | 60 | 10 | 400 | 17.0 | 5.9 |
| 108 | Example | Fe80Nb7B10Cr1.5Cu1.5 | 25 | 600 | 60 | 10 | 400 | 9.0 | 5.2 |
| 109 | Example | Fe84Nb3B10Cr1.5Cu1.5 | 25 | 600 | 60 | 10 | 400 | 9.0 | 5.6 |
| 110 | Example | Fe70Nb7B20Cr1.5Cu1.5 | 25 | 600 | 60 | 10 | 400 | 10.0 | 5.2 |
| 111 | Example | Fe87Nb7B3Cr1.5Cu1.5 | 25 | 600 | 60 | 10 | 400 | 8.0 | 5.3 |
| 112 | Example | Fe72Nb11B14Cr1Cu2 | 25 | 600 | 60 | 10 | 400 | 12.0 | 5.5 |
| 113 | Example | Fe73Nb10B14Cr1Cu2 | 25 | 600 | 60 | 10 | 400 | 12.0 | 5.0 |
| 114 | Example | Fe90Nb5B3.5Cr0.5Cu1 | 25 | 600 | 60 | 10 | 400 | 8.0 | 5.0 |
| 115 | Example | Fe91Nb4.5B3Cr0.5Cu1 | 25 | 600 | 60 | 10 | 400 | 8.0 | 5.0 |
| 116 | Example | Fe74.5Nb14B10Cr0.5Cu1 | 25 | 600 | 60 | 10 | 400 | 11.0 | 5.8 |
| 117 | Example | Fe76.5Nb12B10Cr0.5Cu1 | 25 | 600 | 60 | 10 | 400 | 11.0 | 5.6 |
| 118 | Example | Fe78.5Nb10B10Cr0.5Cu1 | 25 | 600 | 60 | 10 | 400 | 12.0 | 5.9 |
| 119 | Example | Fe81.5Nb7B10Cr0.5Cu1 | 25 | 600 | 60 | 10 | 400 | 14.0 | 5.1 |
| 120 | Example | Fe83.5Nb5B10Cr0.5Cu1 | 25 | 600 | 60 | 10 | 400 | 12.0 | 5.7 |
| 121 | Example | Fe85.5Nb3B10Cr0.5Cu1 | 25 | 600 | 60 | 10 | 400 | 16.0 | 5.5 |
| 122 | Example | Fe80.9Nb7B10P0.1Cu1 | 25 | 600 | 60 | 10 | 400 | 6.0 | 5.9 |
| 123 | Example | Fe81.5Nb7B10P0.5Cu1 | 25 | 600 | 60 | 10 | 400 | 6.0 | 4.9 |
| 124 | Example | Fe81Nb7B10P1Cu1 | 25 | 600 | 60 | 10 | 400 | 6.0 | 5.3 |
| 125 | Example | Fe80Nb7B10P2Cu1 | 25 | 600 | 60 | 10 | 400 | 6.0 | 4.9 |
| 126 | Example | Fe79Nb7B10P3Cu1 | 25 | 600 | 60 | 10 | 400 | 6.0 | 5.9 |
| 127 | Example | Fe78Nb7B10P4Cu1 | 25 | 600 | 60 | 10 | 400 | 7.0 | 5.7 |

TABLE 6-continued

| | Soft magnetic metal powder | | | | | | | | |
|---|---|---|---|---|---|---|---|---|---|
| | Soft magnetic metal particle | | | | | | | | |
| | First shell portion | | | | | Second shell | | Dust core | |
| Experimental No. | Largest crystallite size (B) of Cu crystallites (nm) | Average crystallite size (C) of Cu crystallites (nm) | Average minor axis diameter (D) of Cu crystallites (nm) | C/A | B/A | portion layer including Cu or Cu oxide | Coating portion Coating material | Resin amount (wt %) | Property Withstand voltage (V/mm) |
| 77 | 39.6 | 21.6 | 16.0 | 4.1 | 7.6 | Observed | $P_2O_5$—ZnO—$R_2O$—$Al_2O_3$ | 2 | 528 |
| 78 | 32.4 | 19.0 | 13.1 | 3.6 | 6.1 | Observed | $P_2O_5$—ZnO—$R_2O$—$Al_2O_3$ | 2 | 517 |
| 79 | 36.7 | 22.2 | 15.8 | 4.0 | 6.5 | Observed | $P_2O_5$—ZnO—$R_2O$—$Al_2O_3$ | 2 | 538 |
| 80 | 38.5 | 19.8 | 14.9 | 3.8 | 7.4 | Observed | $P_2O_5$—ZnO—$R_2O$—$Al_2O_3$ | 2 | 533 |
| 81 | 36.7 | 20.6 | 14.5 | 3.7 | 6.5 | Observed | $P_2O_5$—ZnO—$R_2O$—$Al_2O_3$ | 2 | 512 |
| 82 | 39.2 | 20.8 | 15.7 | 3.7 | 7.0 | Observed | $P_2O_5$—ZnO—$R_2O$—$Al_2O_3$ | 2 | 517 |
| 83 | 38.9 | 21.4 | 14.5 | 3.9 | 7.0 | Observed | $P_2O_5$—ZnO—$R_2O$—$Al_2O_3$ | 2 | 549 |
| 84 | 38.5 | 18.4 | 14.9 | 3.6 | 7.5 | Observed | $P_2O_5$—ZnO—$R_2O$—$Al_2O_3$ | 2 | 522 |
| 85 | 35.3 | 22.4 | 13.2 | 3.9 | 6.1 | Observed | $P_2O_5$—ZnO—$R_2O$—$Al_2O_3$ | 2 | 512 |
| 86 | 33.1 | 19.8 | 13.8 | 3.3 | 5.6 | Observed | $P_2O_5$—ZnO—$R_2O$—$Al_2O_3$ | 2 | 538 |
| 87 | 32.8 | 21.4 | 13.9 | 3.6 | 5.6 | Observed | $P_2O_5$—ZnO—$R_2O$—$Al_2O_3$ | 2 | 533 |
| 88 | 36.4 | 21.8 | 13.2 | 4.3 | 7.2 | Observed | $P_2O_5$—ZnO—$R_2O$—$Al_2O_3$ | 2 | 554 |
| 89 | 34.9 | 22.2 | 14.5 | 4.4 | 7.0 | Observed | $P_2O_5$—ZnO—$R_2O$—$Al_2O_3$ | 2 | 522 |
| 90 | 33.8 | 20.0 | 13.9 | 3.6 | 6.1 | Observed | $P_2O_5$—ZnO—$R_2O$—$Al_2O_3$ | 2 | 522 |
| 91 | 37.1 | 22.4 | 15.8 | 4.0 | 6.6 | Observed | $P_2O_5$—ZnO—$R_2O$—$Al_2O_3$ | 2 | 544 |
| 92 | 38.2 | 22.4 | 15.1 | 4.5 | 7.7 | Observed | $P_2O_5$—ZnO—$R_2O$—$Al_2O_3$ | 2 | 560 |
| 93 | 36.4 | 21.6 | 15.7 | 3.7 | 6.2 | Observed | $P_2O_5$—ZnO—$R_2O$—$Al_2O_3$ | 2 | 506 |
| 94 | 34.2 | 21.8 | 15.1 | 3.9 | 6.1 | Observed | $P_2O_5$—ZnO—$R_2O$—$Al_2O_3$ | 2 | 554 |
| 95 | 35.3 | 19.6 | 14.6 | 3.3 | 6.0 | Observed | $P_2O_5$—ZnO—$R_2O$—$Al_2O_3$ | 2 | 517 |
| 96 | 37.8 | 19.8 | 14.9 | 3.4 | 6.4 | Observed | $P_2O_5$—ZnO—$R_2O$—$Al_2O_3$ | 2 | 549 |
| 97 | 36.0 | 22.0 | 15.7 | 4.1 | 6.7 | Observed | $P_2O_5$—ZnO—$R_2O$—$Al_2O_3$ | 2 | 554 |
| 98 | 38.2 | 20.8 | 13.9 | 3.7 | 6.8 | Observed | $P_2O_5$—ZnO—$R_2O$—$Al_2O_3$ | 2 | 506 |
| 99 | 32.8 | 21.6 | 16.0 | 3.8 | 5.7 | Observed | $P_2O_5$—ZnO—$R_2O$—$Al_2O_3$ | 2 | 517 |
| 100 | 36.7 | 20.4 | 14.6 | 3.9 | 6.9 | Observed | $P_2O_5$—ZnO—$R_2O$—$Al_2O_3$ | 2 | 554 |
| 101 | 39.6 | 22.2 | 15.2 | 4.3 | 7.7 | Observed | $P_2O_5$—ZnO—$R_2O$—$Al_2O_3$ | 2 | 522 |
| 102 | 38.5 | 21.2 | 14.2 | 4.1 | 7.4 | Observed | $P_2O_5$—ZnO—$R_2O$—$Al_2O_3$ | 2 | 544 |
| 103 | 35.3 | 18.8 | 16.0 | 3.6 | 6.8 | Observed | $P_2O_5$—ZnO—$R_2O$—$Al_2O_3$ | 2 | 533 |
| 104 | 36.7 | 22.0 | 14.5 | 4.3 | 7.2 | Observed | $P_2O_5$—ZnO—$R_2O$—$Al_2O_3$ | 2 | 528 |
| 105 | 32.8 | 20.4 | 15.4 | 3.6 | 5.8 | Observed | $P_2O_5$—ZnO—$R_2O$—$Al_2O_3$ | 2 | 522 |
| 106 | 34.2 | 22.0 | 15.7 | 4.5 | 7.0 | Observed | $P_2O_5$—ZnO—$R_2O$—$Al_2O_3$ | 2 | 512 |
| 107 | 35.3 | 21.4 | 13.6 | 3.6 | 5.9 | Observed | $P_2O_5$—ZnO—$R_2O$—$Al_2O_3$ | 2 | 533 |
| 108 | 36.7 | 22.0 | 15.8 | 4.2 | 7.0 | Observed | $P_2O_5$—ZnO—$R_2O$—$Al_2O_3$ | 2 | 522 |
| 109 | 37.8 | 18.8 | 15.8 | 3.3 | 6.7 | Observed | $P_2O_5$—ZnO—$R_2O$—$Al_2O_3$ | 2 | 538 |
| 110 | 39.6 | 18.4 | 13.1 | 3.5 | 7.6 | Observed | $P_2O_5$—ZnO—$R_2O$—$Al_2O_3$ | 2 | 560 |
| 111 | 38.9 | 20.4 | 13.8 | 3.9 | 7.3 | Observed | $P_2O_5$—ZnO—$R_2O$—$Al_2O_3$ | 2 | 512 |
| 112 | 38.2 | 18.4 | 13.2 | 3.3 | 6.9 | Observed | $P_2O_5$—ZnO—$R_2O$—$Al_2O_3$ | 2 | 506 |
| 113 | 35.3 | 20.8 | 15.8 | 4.1 | 7.0 | Observed | $P_2O_5$—ZnO—$R_2O$—$Al_2O_3$ | 2 | 528 |
| 114 | 36.7 | 20.6 | 14.5 | 4.1 | 7.3 | Observed | $P_2O_5$—ZnO—$R_2O$—$Al_2O_3$ | 2 | 528 |
| 115 | 37.4 | 21.6 | 13.3 | 4.3 | 7.5 | Observed | $P_2O_5$—ZnO—$R_2O$—$Al_2O_3$ | 2 | 544 |
| 116 | 36.7 | 20.8 | 15.1 | 3.6 | 6.4 | Observed | $P_2O_5$—ZnO—$R_2O$—$Al_2O_3$ | 2 | 544 |
| 117 | 37.8 | 21.4 | 15.2 | 3.9 | 6.8 | Observed | $P_2O_5$—ZnO—$R_2O$—$Al_2O_3$ | 2 | 544 |
| 118 | 32.4 | 18.8 | 13.5 | 3.2 | 5.5 | Observed | $P_2O_5$—ZnO—$R_2O$—$Al_2O_3$ | 2 | 517 |
| 119 | 34.9 | 22.0 | 13.8 | 4.3 | 6.9 | Observed | $P_2O_5$—ZnO—$R_2O$—$Al_2O_3$ | 2 | 538 |
| 120 | 38.2 | 22.2 | 14.2 | 3.9 | 6.7 | Observed | $P_2O_5$—ZnO—$R_2O$—$Al_2O_3$ | 2 | 528 |
| 121 | 33.1 | 20.6 | 14.6 | 3.8 | 6.1 | Observed | $P_2O_5$—ZnO—$R_2O$—$Al_2O_3$ | 2 | 506 |
| 122 | 38.9 | 20.4 | 15.1 | 3.4 | 6.5 | Observed | $P_2O_5$—ZnO—$R_2O$—$Al_2O_3$ | 2 | 533 |
| 123 | 37.1 | 21.2 | 13.6 | 4.4 | 7.6 | Observed | $P_2O_5$—ZnO—$R_2O$—$Al_2O_3$ | 2 | 528 |
| 124 | 32.4 | 19.8 | 15.4 | 3.7 | 6.1 | Observed | $P_2O_5$—ZnO—$R_2O$—$Al_2O_3$ | 2 | 549 |
| 125 | 33.5 | 22.0 | 14.2 | 4.5 | 6.9 | Observed | $P_2O_5$—ZnO—$R_2O$—$Al_2O_3$ | 2 | 528 |
| 126 | 34.2 | 18.4 | 14.2 | 3.1 | 5.8 | Observed | $P_2O_5$—ZnO—$R_2O$—$Al_2O_3$ | 2 | 517 |
| 127 | 38.2 | 19.8 | 15.4 | 3.5 | 6.7 | Observed | $P_2O_5$—ZnO—$R_2O$—$Al_2O_3$ | 2 | 560 |

TABLE 7

| Experimental No. | Comparative example/example | Soft magnetic metal powder Soft magnetic metal particle: Composition (at %) | Average particle size D50 (μm) | Heat treatment conditions: Holding temperature (° C.) | Holding time (min) | Temperature raising rate (° C./min) | Oxygen concentration (ppm) |
|---|---|---|---|---|---|---|---|
| 128 | Example | Fe93.8Nb3.2B2.8P0.1Cu0.1 | 25 | 600 | 60 | 10 | 400 |
| 129 | Example | Fe73.4Nb12B13P0.1Cu1.5 | 25 | 600 | 60 | 10 | 400 |
| 130 | Example | Fe90.9Nb3.2B13P3Cu0.1 | 25 | 600 | 60 | 10 | 400 |
| 131 | Example | Fe70.5Nb14B10P3Cu1.5 | 25 | 600 | 60 | 10 | 400 |
| 132 | Example | Fe80.9Nb7B10P0.1Cu1C1 | 25 | 600 | 60 | 10 | 400 |
| 133 | Example | Fe80.5Nb7B10P0.5Cu1C1 | 25 | 600 | 60 | 10 | 400 |
| 134 | Example | Fe80Nb7B10P1Cu1C1 | 25 | 600 | 60 | 10 | 400 |
| 135 | Example | Fe79Nb7B10P2Cu1C1 | 25 | 600 | 60 | 10 | 400 |
| 136 | Example | Fe78Nb7B10P3Cu1C1 | 25 | 600 | 60 | 10 | 400 |
| 137 | Example | Fe77.5Nb7B10P3.5Cu1C1 | 25 | 600 | 60 | 10 | 400 |
| 138 | Example | Fe93.7Nb3.2B2.8P0.1Cu0.1C0.1 | 25 | 600 | 60 | 10 | 400 |
| 139 | Example | Fe71.4Nb12B13P0.1Cu1.5C2 | 25 | 600 | 60 | 10 | 400 |
| 140 | Example | Fe90.8Nb3.2B2.8P3Cu0.1C0.1 | 25 | 600 | 60 | 10 | 400 |
| 141 | Example | Fe68.5Nb12B13P3Cu1.5C2 | 25 | 600 | 60 | 10 | 400 |
| 142 | Example | Fe81.4Nb7B10Cr0.5P0.1Cu1 | 25 | 600 | 60 | 10 | 400 |
| 143 | Example | Fe81Nb7B10Cr0.5P0.5Cu1 | 25 | 600 | 60 | 10 | 400 |
| 144 | Example | Fe80.5Nb7B10Cr0.5P1Cu1 | 25 | 600 | 60 | 10 | 400 |
| 145 | Example | Fe79.5Nb7B10Cr0.5P2Cu1 | 25 | 600 | 60 | 10 | 400 |
| 146 | Example | Fe78.5Nb7B10Cr0.5P3Cu1 | 25 | 600 | 60 | 10 | 400 |
| 147 | Example | Fe78Nb7B10P3.5Cr0.5Cu1 | 25 | 600 | 60 | 10 | 400 |
| 148 | Example | Fe93.7Nb3.2B2.8Cr0.1P0.1Cu0.1 | 25 | 600 | 60 | 10 | 400 |
| 149 | Example | Fe71.9Nb12B13Cr1.5P0.1Cu1.5 | 25 | 600 | 60 | 10 | 400 |
| 150 | Example | Fe90.8Nb3.2B2.8Cr0.1P3Cu0.1 | 25 | 600 | 60 | 10 | 400 |
| 151 | Example | Fe69Nb12B13Cr1.5P3Cu1.5 | 25 | 600 | 60 | 10 | 400 |
| 152 | Example | Fe80.4Nb7B10Cr0.5P0.1Cu1C1 | 25 | 600 | 60 | 10 | 400 |
| 153 | Example | Fe80Nb7B10Cr0.5P0.5Cu1C1 | 25 | 600 | 60 | 10 | 400 |
| 154 | Example | Fe79.5Nb7B10Cr0.5P1Cu1C1 | 25 | 600 | 60 | 10 | 400 |
| 155 | Example | Fe78.5Nb7B10Cr0.5P2Cu1C1 | 25 | 600 | 60 | 10 | 400 |
| 156 | Example | Fe77.5Nb7B10Cr0.5P3Cu1C1 | 25 | 600 | 60 | 10 | 400 |
| 157 | Example | Fe77Nb7B10P3.5Cr0.5Cu1C1 | 25 | 600 | 60 | 10 | 400 |
| 158 | Example | Fe93.6Nb3.2B2.8Cr0.1P0.1Cu0.1C0.1 | 25 | 600 | 60 | 10 | 400 |
| 159 | Example | Fe69.9Nb12B13Cr1.5P0.1Cu1.5C2 | 25 | 600 | 60 | 10 | 400 |
| 160 | Example | Fe90.7Nb3.2B2.8Cr0.1P3Cu0.1C0.1 | 25 | 600 | 60 | 10 | 400 |
| 161 | Example | Fe67Nb12B13Cr1.5P3Cu1.5C2 | 25 | 600 | 60 | 10 | 400 |
| 162 | Example | Fe79.9Nb7B9P3Si1Cu0.1 | 25 | 600 | 60 | 10 | 400 |
| 163 | Example | Fe77.9Nb7B9P3Si3Cu0.1 | 25 | 600 | 60 | 10 | 400 |
| 164 | Example | Fe75.9Nb7B9P3Si5Cu0.1 | 25 | 600 | 60 | 10 | 400 |
| 165 | Example | Fe70.9Nb7B9P3Si10Cu0.1 | 25 | 600 | 60 | 10 | 400 |
| 166 | Example | Fe65.9Nb7B9P3Si15Cu0.1 | 25 | 600 | 60 | 10 | 400 |
| 167 | Example | Fe78.9Nb7B9P3Si1Cu0.1C1 | 25 | 600 | 60 | 10 | 400 |
| 168 | Example | Fe76.9Nb7B9P3Si3Cu0.1C1 | 25 | 600 | 60 | 10 | 400 |
| 169 | Example | Fe74.9Nb7B9P3Si5Cu0.1C1 | 25 | 600 | 60 | 10 | 400 |
| 170 | Example | Fe69.9Nb7B9P10Si3Cu0.1C1 | 25 | 600 | 60 | 10 | 400 |
| 171 | Example | Fe64.9Nb7B9P15Si3Cu0.1C1 | 25 | 600 | 60 | 10 | 400 |

| Experimental No. | Soft magnetic metal powder Soft magnetic metal particle: Entire particle Average crystallite size of Fe crystallites (nm) | Core portion: Average crystallite size (A) of Cu crystallites (nm) | First shell portion: Largest crystallite size (B) of Cu crystallites (nm) | Average crystallite size (C) of Cu crystallites (nm) | Average minor axis diameter (D) of Cu crystallites (nm) | C/A | B/A |
|---|---|---|---|---|---|---|---|
| 128 | 7.0 | 4.9 | 38.2 | 19.6 | 16.0 | 4.0 | 7.8 |
| 129 | 6.0 | 5.7 | 32.8 | 20.2 | 14.6 | 3.5 | 5.7 |
| 130 | 7.0 | 5.9 | 36.0 | 21.6 | 15.1 | 3.6 | 6.1 |
| 131 | 7.0 | 5.7 | 36.4 | 22.4 | 14.1 | 3.9 | 6.4 |
| 132 | 7.0 | 5.5 | 34.2 | 20.4 | 15.4 | 3.7 | 6.2 |
| 133 | 6.0 | 5.6 | 33.5 | 19.8 | 13.5 | 3.6 | 6.0 |
| 134 | 7.0 | 5.9 | 34.9 | 18.8 | 15.1 | 3.2 | 5.9 |
| 135 | 7.0 | 5.6 | 32.4 | 18.8 | 14.5 | 3.4 | 5.8 |
| 136 | 7.0 | 5.8 | 36.4 | 19.2 | 14.1 | 3.3 | 6.2 |
| 137 | 7.0 | 5.7 | 38.2 | 18.4 | 15.4 | 3.2 | 6.7 |
| 138 | 7.0 | 5.2 | 37.8 | 21.0 | 14.1 | 4.1 | 7.3 |
| 139 | 6.0 | 5.2 | 39.6 | 19.4 | 15.1 | 3.7 | 7.6 |
| 140 | 7.0 | 5.1 | 38.2 | 21.4 | 14.6 | 4.2 | 7.5 |

TABLE 7-continued

| | | | | | | | |
|---|---|---|---|---|---|---|---|
| 141 | 7.0 | 5.8 | 34.6 | 22.0 | 13.6 | 3.8 | 5.9 |
| 142 | 8.0 | 5.0 | 33.8 | 21.2 | 13.1 | 4.3 | 6.8 |
| 143 | 9.0 | 5.0 | 35.3 | 22.2 | 14.6 | 4.4 | 7.0 |
| 144 | 8.0 | 5.6 | 38.9 | 19.4 | 14.1 | 3.5 | 7.0 |
| 145 | 7.0 | 5.0 | 37.8 | 19.6 | 14.2 | 3.9 | 7.5 |
| 146 | 8.0 | 5.9 | 38.9 | 21.0 | 14.2 | 3.5 | 6.5 |
| 147 | 7.0 | 5.3 | 35.3 | 20.6 | 15.7 | 3.9 | 6.7 |
| 148 | 8.0 | 4.9 | 32.4 | 21.4 | 14.1 | 4.4 | 6.7 |
| 149 | 7.0 | 5.9 | 34.9 | 20.0 | 16.0 | 3.4 | 5.9 |
| 150 | 7.0 | 5.0 | 39.2 | 20.0 | 14.1 | 4.0 | 7.8 |
| 151 | 12.0 | 5.4 | 38.2 | 21.0 | 14.5 | 3.9 | 7.1 |
| 152 | 9.0 | 5.8 | 36.0 | 21.4 | 14.8 | 3.7 | 6.2 |
| 153 | 9.0 | 5.7 | 34.6 | 19.4 | 15.5 | 3.4 | 6.0 |
| 154 | 9.0 | 5.3 | 32.4 | 20.8 | 14.2 | 3.9 | 6.1 |
| 155 | 9.0 | 5.8 | 32.4 | 20.4 | 13.2 | 3.5 | 5.6 |
| 156 | 8.0 | 5.9 | 36.0 | 21.6 | 13.5 | 3.7 | 6.1 |
| 157 | 9.0 | 5.6 | 32.8 | 20.8 | 15.5 | 3.7 | 5.8 |
| 158 | 8.0 | 5.1 | 38.5 | 20.6 | 13.3 | 4.0 | 7.5 |
| 159 | 9.0 | 5.2 | 32.8 | 19.4 | 13.6 | 3.7 | 6.3 |
| 160 | 14.0 | 5.5 | 35.6 | 22.0 | 14.6 | 4.0 | 6.5 |
| 161 | 13.0 | 5.3 | 35.6 | 22.2 | 15.4 | 4.2 | 6.7 |
| 162 | 7.0 | 5.5 | 38.2 | 21.6 | 13.3 | 4.0 | 7.0 |
| 163 | 8.0 | 5.6 | 32.4 | 21.4 | 15.1 | 3.8 | 5.8 |
| 164 | 7.0 | 5.2 | 33.1 | 20.8 | 13.2 | 4.0 | 6.3 |
| 165 | 7.0 | 5.3 | 38.9 | 19.8 | 14.5 | 3.7 | 7.3 |
| 166 | 7.0 | 5.7 | 34.2 | 21.0 | 13.6 | 3.7 | 6.0 |
| 167 | 7.0 | 5.2 | 38.2 | 21.6 | 13.9 | 4.1 | 7.3 |
| 168 | 8.0 | 5.8 | 36.7 | 19.0 | 14.4 | 3.3 | 6.3 |
| 169 | 7.0 | 5.3 | 34.6 | 19.4 | 14.5 | 3.7 | 6.5 |
| 170 | 10.0 | 5.1 | 38.2 | 20.6 | 13.2 | 4.1 | 7.5 |
| 171 | 8.0 | 4.9 | 35.6 | 19.6 | 15.2 | 4.0 | 7.3 |

| | Soft magnetic metal powder | | | Dust core | |
|---|---|---|---|---|---|
| | Soft magnetic metal particle Second shell | | | | |
| Experimental No. | portion layer including Cu or Cu oxide | Coating portion Coating material | | Resin amount (wt %) | Property Withstand voltage (V/mm) |
| 128 | Observed | $P_2O_5$—ZnO—$R_2O$—$Al_2O_3$ | | 2 | 544 |
| 129 | Observed | $P_2O_5$—ZnO—$R_2O$—$Al_2O_3$ | | 2 | 549 |
| 130 | Observed | $P_2O_5$—ZnO—$R_2O$—$Al_2O_3$ | | 2 | 549 |
| 131 | Observed | $P_2O_5$—ZnO—$R_2O$—$Al_2O_3$ | | 2 | 506 |
| 132 | Observed | $P_2O_5$—ZnO—$R_2O$—$Al_2O_3$ | | 2 | 506 |
| 133 | Observed | $P_2O_5$—ZnO—$R_2O$—$Al_2O_3$ | | 2 | 533 |
| 134 | Observed | $P_2O_5$—ZnO—$R_2O$—$Al_2O_3$ | | 2 | 549 |
| 135 | Observed | $P_2O_5$—ZnO—$R_2O$—$Al_2O_3$ | | 2 | 560 |
| 136 | Observed | $P_2O_5$—ZnO—$R_2O$—$Al_2O_3$ | | 2 | 538 |
| 137 | Observed | $P_2O_5$—ZnO—$R_2O$—$Al_2O_3$ | | 2 | 522 |
| 138 | Observed | $P_2O_5$—ZnO—$R_2O$—$Al_2O_3$ | | 2 | 549 |
| 139 | Observed | $P_2O_5$—ZnO—$R_2O$—$Al_2O_3$ | | 2 | 533 |
| 140 | Observed | $P_2O_5$—ZnO—$R_2O$—$Al_2O_3$ | | 2 | 512 |
| 141 | Observed | $P_2O_5$—ZnO—$R_2O$—$Al_2O_3$ | | 2 | 512 |
| 142 | Observed | $P_2O_5$—ZnO—$R_2O$—$Al_2O_3$ | | 2 | 538 |
| 143 | Observed | $P_2O_5$—ZnO—$R_2O$—$Al_2O_3$ | | 2 | 560 |
| 144 | Observed | $P_2O_5$—ZnO—$R_2O$—$Al_2O_3$ | | 2 | 528 |
| 145 | Observed | $P_2O_5$—ZnO—$R_2O$—$Al_2O_3$ | | 2 | 549 |
| 146 | Observed | $P_2O_5$—ZnO—$R_2O$—$Al_2O_3$ | | 2 | 533 |
| 147 | Observed | $P_2O_5$—ZnO—$R_2O$—$Al_2O_3$ | | 2 | 517 |
| 148 | Observed | $P_2O_5$—ZnO—$R_2O$—$Al_2O_3$ | | 2 | 538 |
| 149 | Observed | $P_2O_5$—ZnO—$R_2O$—$Al_2O_3$ | | 2 | 522 |
| 150 | Observed | $P_2O_5$—ZnO—$R_2O$—$Al_2O_3$ | | 2 | 506 |
| 151 | Observed | $P_2O_5$—ZnO—$R_2O$—$Al_2O_3$ | | 2 | 533 |
| 152 | Observed | $P_2O_5$—ZnO—$R_2O$—$Al_2O_3$ | | 2 | 528 |
| 153 | Observed | $P_2O_5$—ZnO—$R_2O$—$Al_2O_3$ | | 2 | 549 |
| 154 | Observed | $P_2O_5$—ZnO—$R_2O$—$Al_2O_3$ | | 2 | 517 |
| 155 | Observed | $P_2O_5$—ZnO—$R_2O$—$Al_2O_3$ | | 2 | 517 |
| 156 | Observed | $P_2O_5$—ZnO—$R_2O$—$Al_2O_3$ | | 2 | 528 |
| 157 | Observed | $P_2O_5$—ZnO—$R_2O$—$Al_2O_3$ | | 2 | 544 |
| 158 | Observed | $P_2O_5$—ZnO—$R_2O$—$Al_2O_3$ | | 2 | 528 |
| 159 | Observed | $P_2O_5$—ZnO—$R_2O$—$Al_2O_3$ | | 2 | 560 |
| 160 | Observed | $P_2O_5$—ZnO—$R_2O$—$Al_2O_3$ | | 2 | 544 |
| 161 | Observed | $P_2O_5$—ZnO—$R_2O$—$Al_2O_3$ | | 2 | 560 |

TABLE 7-continued

| | | | | |
|---|---|---|---|---|
| 162 | Observed | $P_2O_5$—ZnO—$R_2O$—$Al_2O_3$ | 2 | 533 |
| 163 | Observed | $P_2O_5$—ZnO—$R_2O$—$Al_2O_3$ | 2 | 538 |
| 164 | Observed | $P_2O_5$—ZnO—$R_2O$—$Al_2O_3$ | 2 | 528 |
| 165 | Observed | $P_2O_5$—ZnO—$R_2O$—$Al_2O_3$ | 2 | 517 |
| 166 | Observed | $P_2O_5$—ZnO—$R_2O$—$Al_2O_3$ | 2 | 517 |
| 167 | Observed | $P_2O_5$—ZnO—$R_2O$—$Al_2O_3$ | 2 | 544 |
| 168 | Observed | $P_2O_5$—ZnO—$R_2O$—$Al_2O_3$ | 2 | 549 |
| 169 | Observed | $P_2O_5$—ZnO—$R_2O$—$Al_2O_3$ | 2 | 522 |
| 170 | Observed | $P_2O_5$—ZnO—$R_2O$—$Al_2O_3$ | 2 | 538 |
| 171 | Observed | $P_2O_5$—ZnO—$R_2O$—$Al_2O_3$ | 2 | 554 |

TABLE 8

| | | Soft magnetic metal powder Soft magnetic metal particle | | | | | | | |
|---|---|---|---|---|---|---|---|---|---|
| | | | | Heat treatment conditions | | | | | |
| Experimental No. | Comparative example/example | Composition (at %) | Average particle size D50 (μm) | Holding temperature (° C.) | Holding time (min) | Temperature raising rate (° C./min) | Oxygen concentration (ppm) | Entire particle Average crystallite size of Fe crystallites (nm) | Core portion Average crystallite size (A) of Cu crystallites (nm) |
| 172 | Example | Fe86.9Cu0.1P1Si2B9C1 | 25 | 450 | 60 | 10 | 400 | 18.0 | 5.7 |
| 173 | Example | Fe80.9Cu0.1P1Si8B9C1 | 25 | 450 | 60 | 10 | 400 | 18.0 | 6.1 |
| 174 | Example | Fe82.9Cu0.1P2Si2B9C4 | 25 | 450 | 60 | 10 | 400 | 19.0 | 5.2 |
| 175 | Example | Fe76.9Cu0.1P2Si8B9C4 | 25 | 450 | 60 | 10 | 400 | 21.0 | 5.4 |
| 176 | Example | Fe83.3Si6B10Cu0.7 | 25 | 450 | 60 | 10 | 400 | 25.0 | 5.5 |
| 177 | Example | Fe83.3Si4B10P2Cu0.7 | 25 | 450 | 60 | 10 | 400 | 23.0 | 5.5 |
| 178 | Example | Fe83.3Si2B10P4Cu0.7 | 25 | 450 | 60 | 10 | 400 | 18.0 | 5.0 |
| 179 | Example | Fe83.3B10P6Cu0.7 | 25 | 450 | 60 | 10 | 400 | 18.0 | 6.4 |
| 180 | Example | Fe83.3Si3B5P8Cu0.7 | 25 | 450 | 60 | 10 | 400 | 18.0 | 5.1 |
| 181 | Example | Fe83.3Si1B13P2Cu0.7 | 25 | 450 | 60 | 10 | 400 | 18.0 | 5.5 |

| | Soft magnetic metal powder | | | | | | | | |
|---|---|---|---|---|---|---|---|---|---|
| | Soft magnetic metal particle | | | | | | | | |
| | First shell portion | | | | | | | | |
| Experimental No. | Largest crystallite size (B) of Cu crystallites (nm) | Average crystallite size (C) of Cu crystallites (nm) | Average minor axis diameter (D) of Cu crystallites (nm) | C/A | B/A | Second shell portion layer including Cu or Cu oxide | Coating portion Coating material | Dust core Resin amount (wt %) | Dust core Property Withstand voltage (V/mm) |
| 172 | 39.3 | 21.0 | 15.8 | 3.7 | 6.9 | Observed | $P_2O_5$—ZnO—$R_2O$—$Al_2O_3$ | 2 | 549 |
| 173 | 41.2 | 20.9 | 13.5 | 3.4 | 6.7 | Observed | $P_2O_5$—ZnO—$R_2O$—$Al_2O_3$ | 2 | 533 |
| 174 | 32.1 | 21.0 | 15.0 | 4.0 | 6.1 | Observed | $P_2O_5$—ZnO—$R_2O$—$Al_2O_3$ | 2 | 549 |
| 175 | 30.8 | 21.0 | 15.5 | 3.9 | 5.7 | Observed | $P_2O_5$—ZnO—$R_2O$—$Al_2O_3$ | 2 | 512 |
| 176 | 42.8 | 21.1 | 14.2 | 3.8 | 7.8 | Observed | $P_2O_5$—ZnO—$R_2O$—$Al_2O_3$ | 2 | 506 |
| 177 | 31.8 | 21.0 | 12.1 | 3.8 | 5.7 | Observed | $P_2O_5$—ZnO—$R_2O$—$Al_2O_3$ | 2 | 544 |
| 178 | 39.3 | 21.0 | 15.7 | 4.2 | 7.8 | Observed | $P_2O_5$—ZnO—$R_2O$—$Al_2O_3$ | 2 | 549 |
| 179 | 34.1 | 21.1 | 16.0 | 3.3 | 5.3 | Observed | $P_2O_5$—ZnO—$R_2O$—$Al_2O_3$ | 2 | 522 |
| 180 | 35.2 | 21.1 | 16.4 | 4.1 | 6.9 | Observed | $P_2O_5$—ZnO—$R_2O$—$Al_2O_3$ | 2 | 538 |
| 181 | 35.3 | 20.9 | 15.2 | 3.8 | 6.4 | Observed | $P_2O_5$—ZnO—$R_2O$—$Al_2O_3$ | 2 | 517 |

According to tables 5 to 8, it can be confirmed that even when the composition of the nanocrystal alloy is changed, when B/A is within the above range, the dust core having good withstand voltage is obtained. On the other hand, it can be confirmed that when B/A falls out of the above range, the withstand voltage of the dust core becomes worse. That is, it can be confirmed that the withstand voltage of the dust core can be improved by setting B/A within the above range regardless of the composition of the nanocrystal alloy. In addition, it can be confirmed that in order to make B/A within the above range, preferably, 0.1 atom % or more of Cu is included in the nanocrystal alloy.

REFERENCE SIGNS LIST

| | |
|---|---|
| 1 | coated particle |
| 10 | coating portion |
| 2 | soft magnetic metal particle |
| 2a | core portion |

-continued

| | | |
|---|---|---|
| | 3a | Cu crystallite |
| | 5 | amorphous substance |
| 2b | first shell portion | |
| | 3b | Cu crystallite |
| | 5 | amorphous substance |
| 2c | second shell portion | |

What is claimed is:

1. Soft magnetic metal powder, comprising a plurality of soft magnetic metal particles configured by a Fe-based nanocrystal alloy comprising Cu, wherein the soft magnetic metal particles have core portions and first shell portions surrounding circumferences of the core portions;

B/A is 3.0 or more and 1000 or less, in which an average crystallite size of Cu crystallites existing in the core portions is set as A, and the largest crystallite size of Cu crystallites existing in the first shell portions is set as B.

2. The soft magnetic metal powder according to claim 1, wherein C/A is 2.0 or more and 50 or less, in which the average crystallite size of the Cu crystallites existing in the core portions is set as A, and an average crystallite size of Cu crystallites existing in the first shell portions is set as C.

3. The soft magnetic metal powder according to claim 2, wherein D is 3.0 nm or more and 20 nm or less, in which an average minor axis diameter of the Cu crystallites existing in the first shell portions is set as D.

4. The soft magnetic metal powder according to claim 1, wherein D is 3.0 nm or more and 20 nm or less, in which an average minor axis diameter of the Cu crystallites existing in the first shell portions is set as D.

5. The soft magnetic metal powder according to claim 1, wherein an average crystallite size of Fe crystallites of the soft magnetic metal particles is 1.0 nm or more and 30 nm or less.

6. The soft magnetic metal powder according to claim 1, wherein the soft magnetic metal particles have second shell portions surrounding circumferences of the first shell portions, and the second shell portions are layers comprising Cu or Cu oxide.

7. The soft magnetic metal powder according to claim 1, wherein surfaces of the soft magnetic metal particles are coated by coating portions; and the coating portions comprise a compound of one or more elements selected from a group consisting of P, Si, Bi, and Zn.

8. A dust core, which is configured by the soft magnetic metal powder according to claim 1.

9. A magnetic component comprising the dust core according to claim 8.

* * * * *